US009604108B1

(12) United States Patent
Dunnell et al.

(10) Patent No.: US 9,604,108 B1
(45) Date of Patent: Mar. 28, 2017

(54) PARABOLIC GOLF CLUB SYSTEM

(71) Applicants: Nathaniel Dunnell, Fargo, ND (US); Joshua Dunnell, Moorhead, MN (US)

(72) Inventors: Nathaniel Dunnell, Fargo, ND (US); Joshua Dunnell, Moorhead, MN (US)

( * ) Notice: Subject to any disclaimer, the term of this patent is extended or adjusted under 35 U.S.C. 154(b) by 0 days.

(21) Appl. No.: 14/803,017

(22) Filed: Jul. 17, 2015

(51) Int. Cl.
*A63B 53/02* (2015.01)
*A63B 53/00* (2015.01)
*A63B 53/04* (2015.01)

(52) U.S. Cl.
CPC ..... *A63B 53/02* (2013.01); *A63B 53/007* (2013.01); *A63B 53/0487* (2013.01)

(58) Field of Classification Search
CPC ... A63B 53/02; A63B 53/007; A63B 53/0466; A63B 53/047; A63B 53/0487; A63B 53/04
See application file for complete search history.

(56) References Cited

U.S. PATENT DOCUMENTS

D137,064 S * 1/1944 Roberts ..... 273/129 R
4,340,230 A 7/1982 Churchward
4,895,371 A 1/1990 Bushner
5,335,913 A 8/1994 White
D359,330 S * 6/1995 Channell ..... D21/741
5,456,464 A * 10/1995 Davenport ..... A63B 53/0487 473/251
D381,382 S * 7/1997 Fenton, Jr. ..... D21/743
5,688,189 A 11/1997 Bland
D399,274 S * 10/1998 Bradford ..... D21/736
D422,041 S * 3/2000 Bradford ..... D21/736
6,652,390 B2 * 11/2003 Bradford ..... A63B 53/0487 473/340
6,749,523 B1 6/2004 Forzano
6,896,625 B2 * 5/2005 Grace ..... A63B 53/0487 473/251
D529,560 S * 10/2006 Madore ..... D21/743
7,156,752 B1 1/2007 Bennett
(Continued)

FOREIGN PATENT DOCUMENTS

DE 202013008343 U1 * 12/2013 ..... A63B 53/04
DE 102014013811 A1 * 6/2015 ..... A63B 53/04

OTHER PUBLICATIONS

Rob Sauerhaft, "23 New Drivers Tested & Rated", Golf Magazine, Mar. 2014, pp. 93-98, 104-110, vol. 56 No. 3, TI Golf Holdings, Inc., New York, USA.

(Continued)

*Primary Examiner* — Stephen Blau

(57) ABSTRACT

A parabolic golf club system having a club head consisting of a parabolic path with a club face positioned coincident with the directrix and hosel (shaft) positioned at the focus. In other embodiments bores may be added along the parabolic path where various weights are installed to alter the club head properties such as MOI, CG, and overall mass. In other embodiments a substantially parabolic shaped bore may be formed in the club head allowing installation of parabolically shaped weights, weight plates, weight cartridges and the like to further alter club head properties. Further customization is achieved by allowing a golfer to select from various face inserts, face patterns, hosel configurations, and sight aid choices.

23 Claims, 18 Drawing Sheets

(56) References Cited

U.S. PATENT DOCUMENTS

| | | | | |
|---|---|---|---|---|
| 7,201,668 | B1 * | 4/2007 | Pamias | A63B 53/007 473/288 |
| 7,223,178 | B2 * | 5/2007 | Henry | A63B 47/02 294/19.2 |
| D551,310 | S * | 9/2007 | Kuan | D21/759 |
| 7,331,876 | B2 | 2/2008 | Klein | |
| 7,404,772 | B2 | 7/2008 | Koide | |
| 7,431,663 | B2 * | 10/2008 | Pamias | A63B 53/007 473/288 |
| D585,510 | S * | 1/2009 | Murrieta | D21/736 |
| 7,922,603 | B2 * | 4/2011 | Boyd | A63B 53/04 473/334 |
| 8,096,039 | B2 | 1/2012 | Soracco | |
| 8,177,664 | B2 * | 5/2012 | Horii | A63B 53/0487 473/340 |
| 8,251,836 | B2 * | 8/2012 | Brandt | A63B 53/007 473/340 |
| 8,303,434 | B1 * | 11/2012 | DePaul | A63B 53/0487 473/255 |
| 8,382,604 | B2 | 2/2013 | Billings | |
| 8,430,763 | B2 | 4/2013 | Beach | |
| 8,651,974 | B2 * | 2/2014 | Guerriero | A63B 60/50 473/327 |
| 9,433,834 | B2 * | 9/2016 | Stites | A63B 53/0466 |
| 2002/0151374 | A1 * | 10/2002 | Imamura | A63B 53/0487 473/236 |
| 2003/0228925 | A1 * | 12/2003 | Rohrer | A63B 53/0487 473/251 |
| 2004/0142762 | A1 * | 7/2004 | Bunker | A63B 69/3685 473/340 |
| 2006/0211513 | A1 * | 9/2006 | Uglietto | A63B 53/04 473/324 |
| 2007/0191135 | A1 * | 8/2007 | Nilsson | A63B 53/0487 473/340 |
| 2008/0146372 | A1 * | 6/2008 | John | A63B 53/007 473/341 |
| 2008/0261715 | A1 | 10/2008 | Carter | |
| 2009/0111603 | A1 * | 4/2009 | Romero | A63B 53/047 473/330 |
| 2010/0190573 | A1 * | 7/2010 | Boyd | A63B 53/04 473/334 |
| 2011/0092306 | A1 * | 4/2011 | Lee | A63B 53/0487 473/240 |
| 2011/0275453 | A1 * | 11/2011 | Tavares | A63B 53/04 473/334 |
| 2012/0088641 | A1 | 4/2012 | Shah | |
| 2013/0203522 | A1 | 8/2013 | Franklin et al. | |
| 2013/0244808 | A1 * | 9/2013 | Bennett | A63B 53/06 473/335 |

OTHER PUBLICATIONS

Rob Sauerhaft, "Club Test 2013: Putters", Golf Magazine, Jun. 2013, pp. 143-152, vol. 55 No. 6, TI Golf Holdings, Inc., New York, USA.

Mark Dee, "Mallet Mania", Golf Magazine, Sep. 2013, pp. 110-113, vol. 55 No. 9, TI Golf Holdings, Inc., New York, USA.

Rob Sauerhaft, "Club Test 2012: Hole It!", Jun. 2012, pp. 133-136, 138-142, vol. 54 No. 6, TI Golf Holdings, Inc., New York, USA.

Connell Barrett, "Radical Rollers: Beyond the Belly", Jul. 2012, pp. 122-123, vol. 54 No. 7, TI Golf Holdings, Inc., New York, USA.

Rob Sauerhaft, "Belly Putters: Sharp Shooters", Aug. 2012, pp. 96-97, vol. 54 No. 8, TI Golf Holdings, Inc., New York, USA.

Taylor Made 2011 Putter Brochure, Taylor Made Golf Company, Inc., 5545 Fermi Court, Carlsbad, CA 92008.

Odyssey 2010 "Backstryke" Putter Brochure, Callaway Golf Company, 2180 Rutherford Road, Carlsbad, CA 92008.

Odyssey 2010 Product Catalog, Callaway Golf Company, 2180 Rutherford Road, Carlsbad, CA 92008.

Odyssey "D.A.R.T." Putter Brochure, Callaway Golf Company, 2180 Rutherford Road, Carlsbad, CA 92008.

Rob Sauerhaft, "Putters & Wedges: Club Test 2015", Jun. 2015, pp. 117-127, vol. 57 No. 6, TI Golf Holdings, Inc., New York, USA.

* cited by examiner

FIG. 12A
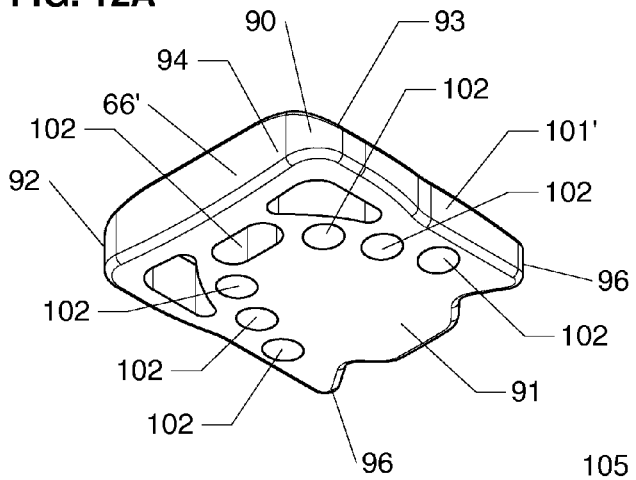
FIG. 12B
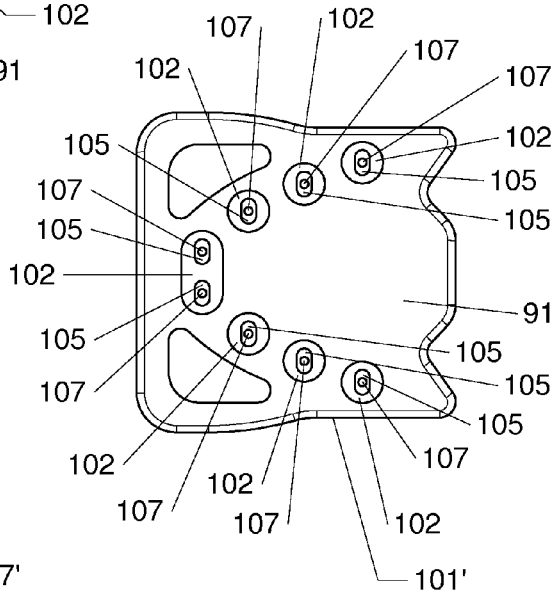
FIG. 12C
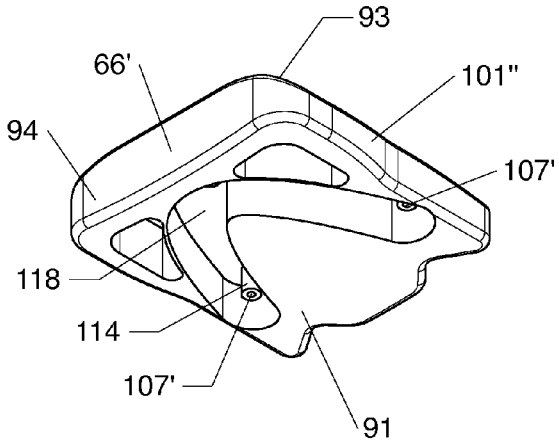
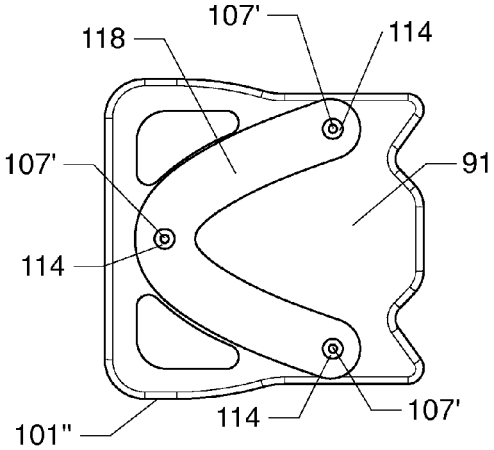
FIG. 12D

FIG. 14A
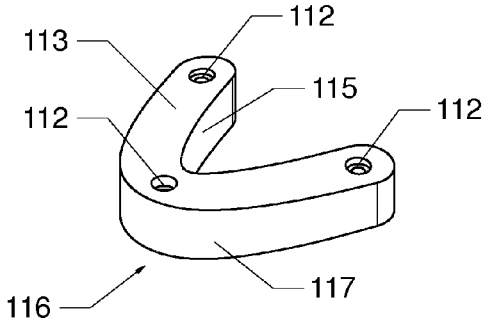
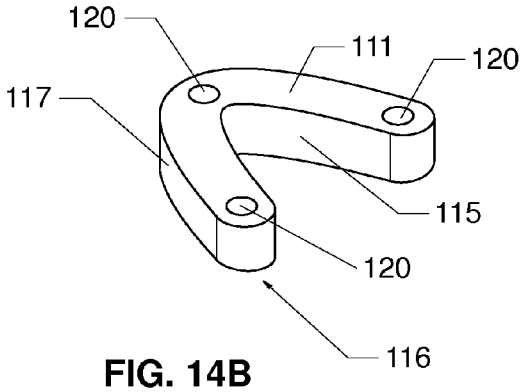
FIG. 14B
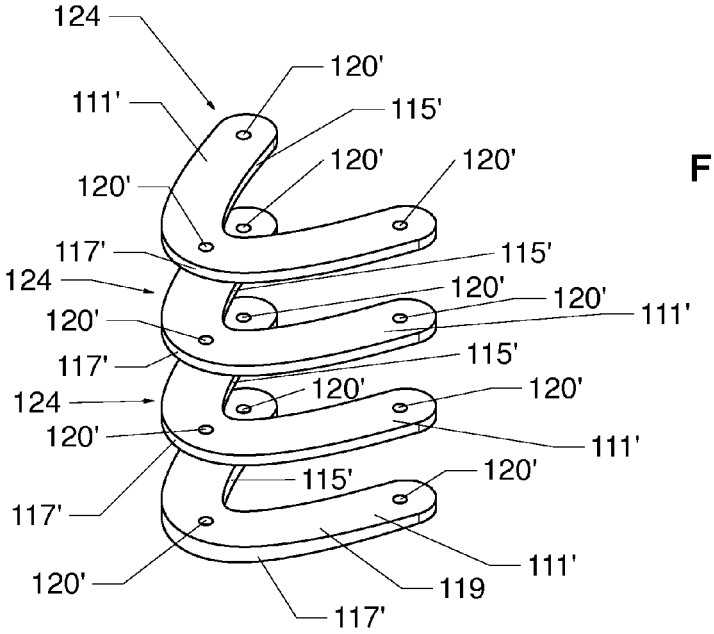
FIG. 14C
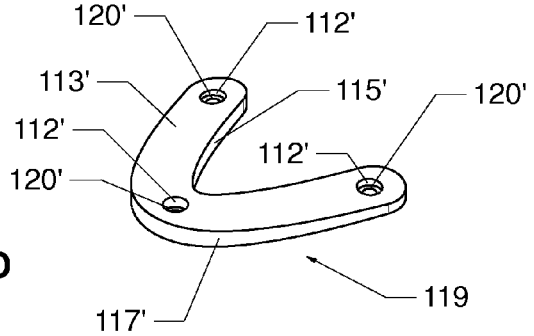
FIG. 14D

FIG. 15A
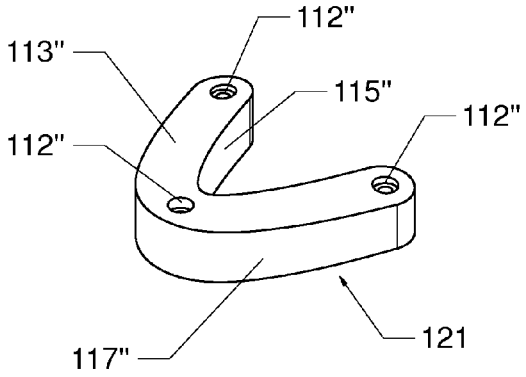
FIG. 15B
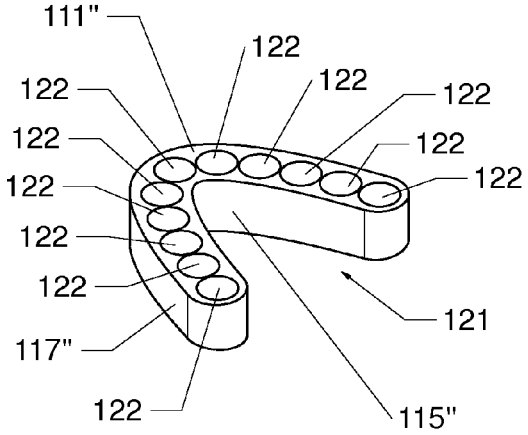
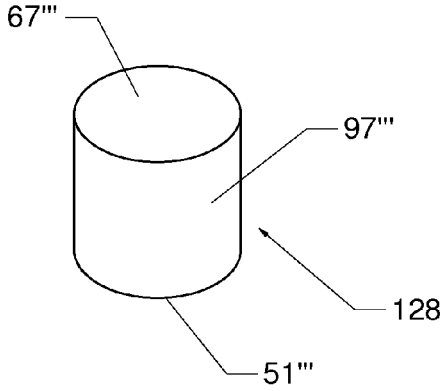
FIG. 15C
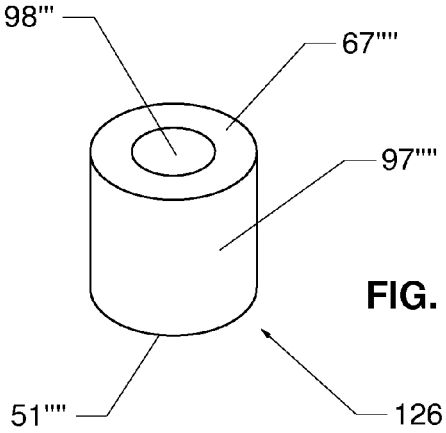
FIG. 15D
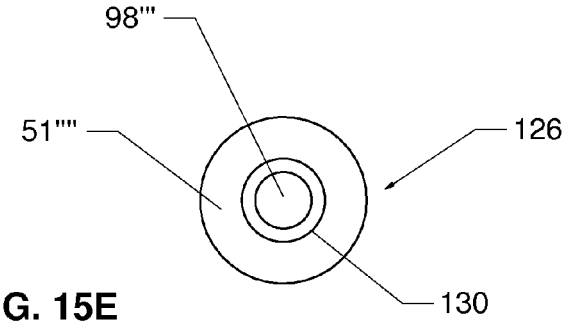
FIG. 15E FIG. 16A
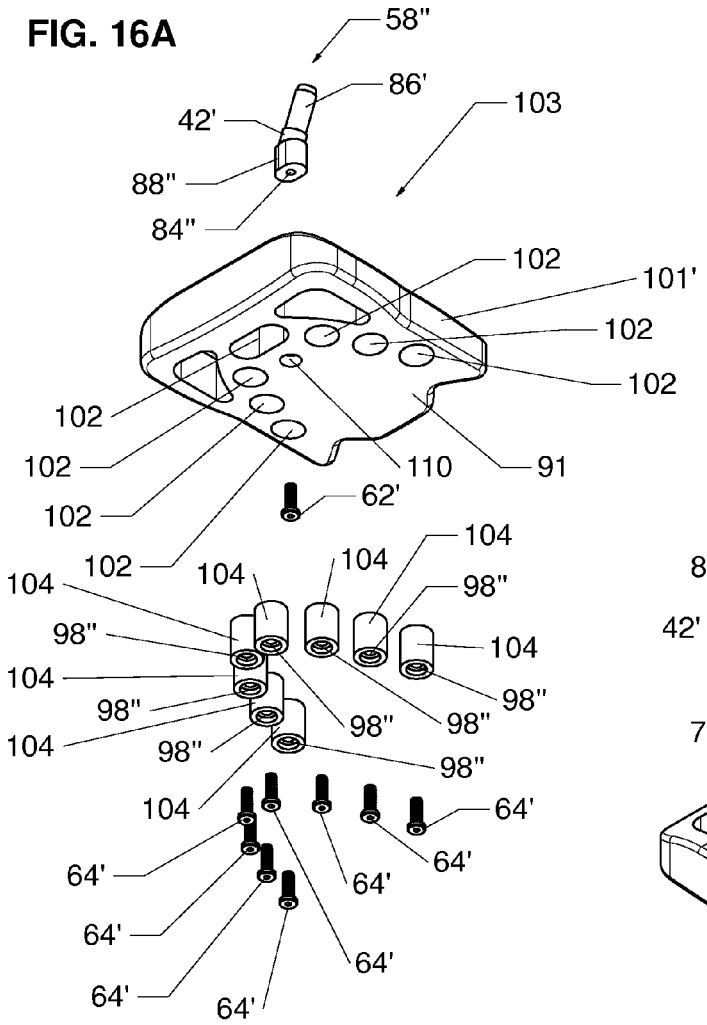
FIG. 16B
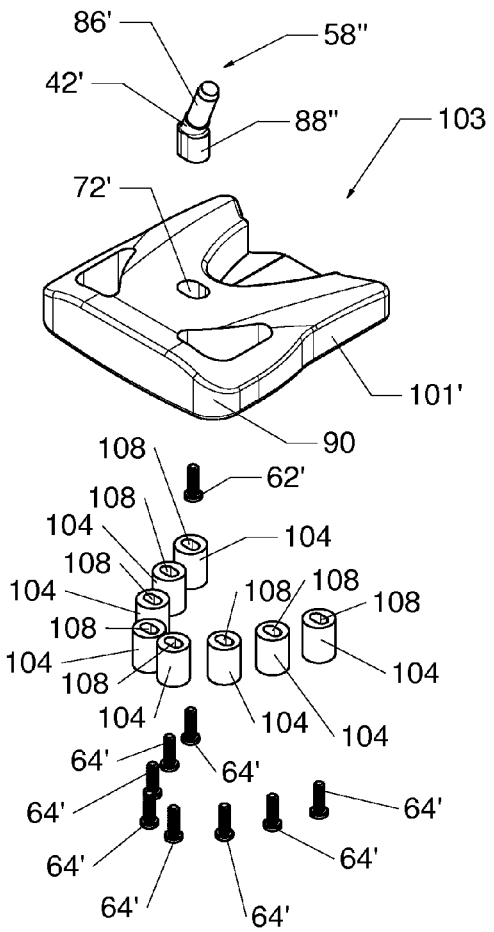
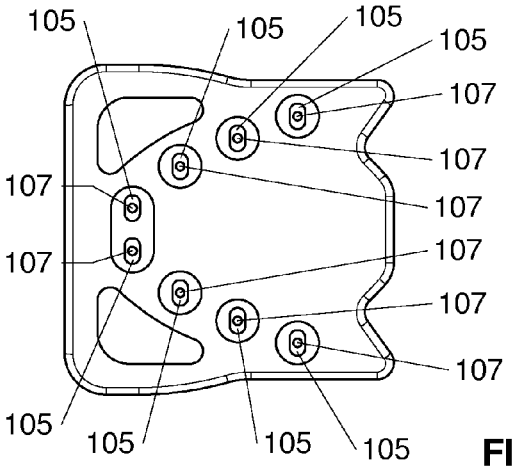
FIG. 16C FIG. 17A
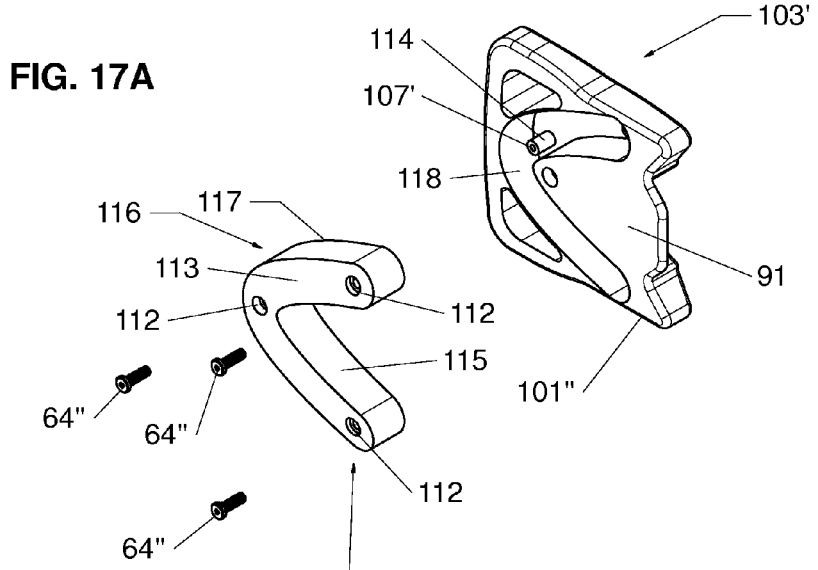
FIG. 17B
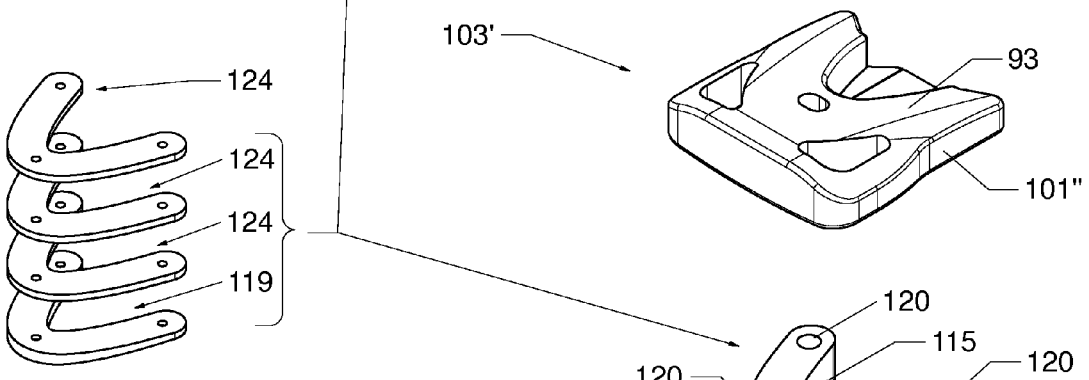
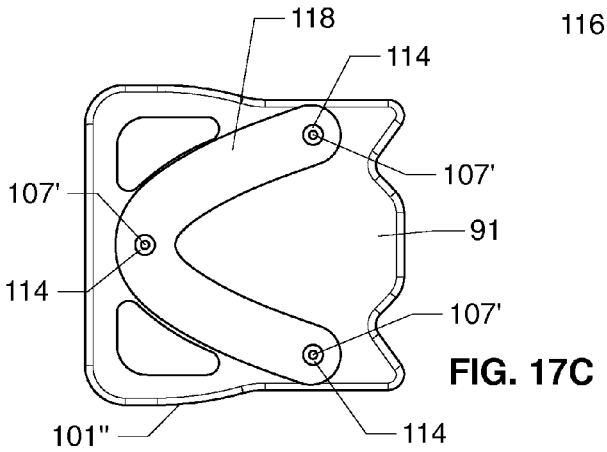
FIG. 17C FIG. 18A
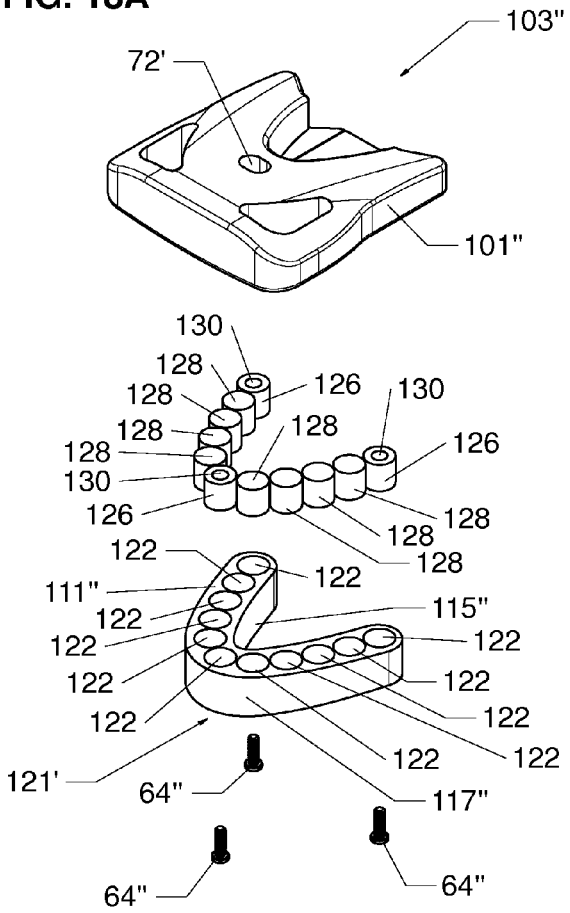
FIG. 18B
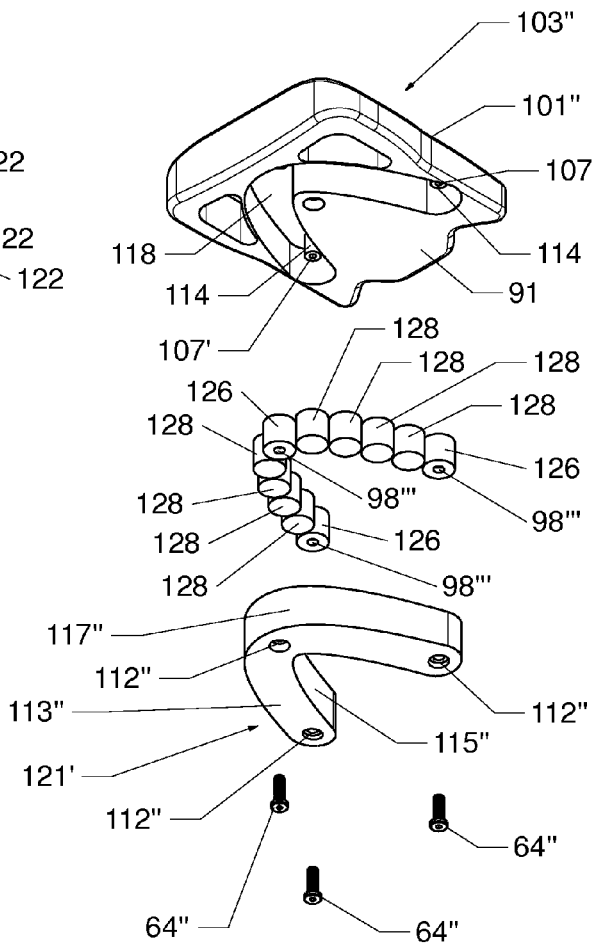
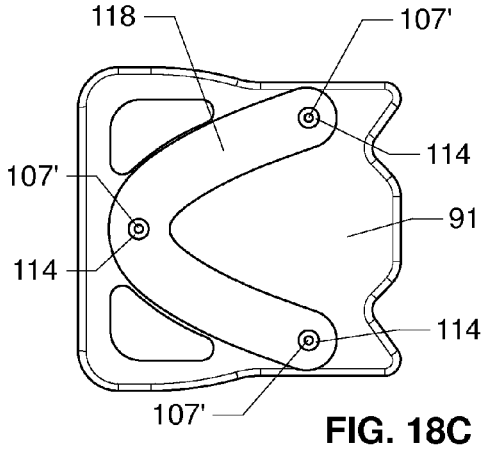
FIG. 18C

PARABOLIC GOLF CLUB SYSTEM

BACKGROUND

Prior Art

The following is a tabulation of some prior art that appears relevant:

U.S. patents

| Pat. No. | Kind Code | Issue Date | Patentee |
|---|---|---|---|
| 4,340,230 | N/A | 1982 Jul. 20 | Churchward |
| 4,895,371 | N/A | 1990 Jan. 23 | Bushner |
| 5,335,913 | N/A | 1994 Aug. 9 | White |
| 5,688,189 | N/A | 1997 Nov. 18 | Bland |
| 6,749,523 | B1 | 2004 Jun. 15 | Forzano |
| 7,156,752 | B1 | 2007 Jan. 2 | Bennett |
| 7,331,876 | B2 | 2008 Feb. 19 | Klein |
| 7,404,772 | B2 | 2008 Jul. 29 | Niigata TLO Corp. |
| 8,096,039 | B2 | 2012 Jun. 17 | Cobra Golf Inc. |
| 8,382,604 | B2 | 2013 Feb. 26 | Dogleg Right Corp. |

U.S. Patent Application Publications

| Patent Number | Kind Code | Publ. Date | Applicant |
|---|---|---|---|
| 2008/0261715 | A1 | 2008 Oct. 23 | Carter |
| 2010/0190573 | A1 | 2010 Jul. 29 | Boyd |
| 2011/0275453 | A1 | 2011 Nov. 10 | Nike, Inc. |
| 2012/0088641 | A1 | 2012 Apr. 12 | Shah |
| 2013/0203522 | A1 | 2013 Aug. 8 | Nike, Inc. |

Nonpatent Literature Documents

Sauerhaft, Rob; et. al., *Golf Magazine,* "23 New Drivers Tested & Rated" (March 2014)

Sauerhaft, Rob; et. al., *Golf Magazine*, "Club Test 2013: Putters" (June 2013)

Dee, Mark, *Golf Magazine*, "New Putters: Mallet Mania" (September 2013)

Sauerhaft, Rob; et. al., *Golf Magazine*, "Club Test 2012: Hole It!" (June 2012)

Barrett, Connell, *Golf Magazine*, "Radical Rollers: Beyond the Belly" (July 2012)

Sauerhaft, Rob, *Golf Magazine*, "Belly Putters: Sharp Shooters" (August 2012)

Odyssey "BackStryke" Putter Brochure (2010)

Sauerhaft, Rob; et. al., *Golf Magazine*, "Club Test 2015" (June 2015)

Originally golf clubs were simple devices with a plain head attached to a shaft. These "traditional" clubs, as they are sometimes referred to, usually consisted of a flat blade connected to a standard length shaft. Golfers using these traditional golf clubs were forced to accept the equipment available to them whether it appealed to them or not. The ability to customize a golf club in the early days was simply not available to golfers.

Today golf clubs and putters are as varied as the golfers using them. There are a multitude of putter head designs such as blades, midsize mallets, and high moment of inertia (MOI) putters. Additionally putters are available with standard length shafts, belly length, and long shaft models to appeal to a wide range of golfers with a wide variety of skill levels.

The belly shaft or long shaft putters are thought to improve the putting stroke by producing a consistent "pendulum" swing motion by "anchoring" the grip end to the belly, chest, chin or other location on the body of a golfer. However, effective Jan. 1, 2016 the anchored putting stroke is banned by the USGA. Many golfers will want to replace their anchoring putters with a new putter design providing the same stability and feel as their anchoring putters provided.

The moment of inertia (MOI) and center of gravity (CG) location of a golf club affect the ability of a club to swing along an intended path. Increasing MOI and moving CG away from the shaft and face generally makes golf clubs more forgiving, reduces the amount the club head twists on off-center ball strikes, allowing the club face to remain square at impact. Many club designs utilize adjustable weights to allow the golfer to adjust the MOI and center of gravity (CG) of the club such as U.S. Pat. No. 4,340,230 (1982), U.S. Pat. No. 7,331,876 (2008), U.S. Pat. No. 5,688,189 (1997), and U.S. Pat. No. 6,749,523 (2004). The adjustable weight configurations in the patents above provide linear weight locations. Limiting the weight adjustment characteristics to substantially linear locations reduces the amount the MOI or CG location may be adjusted.

Club head geometry in combination with shaft location may be used to create a more forgiving golf club appealing to a wide array of golfers of various skill levels. Many previous golf club designs utilized simple geometry including "T" shapes such as U.S. Pat. No. 4,895,371 (1990) and "U" or "V" shapes such as U.S. Patent Application US 2010/0190573 (2010) with the shafts generally located at or near the face. The geometries discussed above provide limited forgiveness for the golfer. Linear intersecting geometries such as "T" shapes provide improved forgiveness when the ball is struck near the intersection of the lines forming the "T". When a ball is contacted further from the intersection point, increased twisting occurs at the face. This increased twisting is increasingly likely to result in a "pushed" or "pulled" shot. A geometry such as the "U" or "V" shapes generally provide improved stability compared to a "T" shape by moving weight to the outer limits of a club head. However, unless the shaft is placed in an optimal location for the geometry, the club head can still twist on off-center hits likely resulting in a "pushed" or "pulled" shot.

SUMMARY

In accordance with one or more aspects, a golf club comprises a club head utilizing parabolic features and properties to create an inherently stable club head. In one embodiment the club head contains a planar striking face located along a directrix of a parabola and a shaft located at a focus of the parabola.

In one embodiment the planar striking face, located at the directrix, may be integrally formed with the putter head. The planar striking face may be smooth or include various patterns such as overlapping arcuate or horizontal grooves or furrows. Additionally, the planar striking face may contain an insert cavity where a face insert may be installed. The face insert allows a golfer to select from a wide array of materials, patterns and the like to customize the impact properties of the planar striking face to suit their putting technique and individuality.

In one embodiment the shaft is mounted into a simple angled bore located at the focus in the club head. The shaft angle and location are fixed and are not easily adjustable by the golfer. Additionally, the shaft mounting device may utilize an interchangeable hosel to join the shaft to the club head. The interchangeable hosel allows the golfer to select from various hosel configurations to customize shaft position, shaft feel, and aesthetic properties. The interchangeable hosel also allows a golfer to easily change between a right-hand club and a left-hand golf club orientation.

In one embodiment, the club head may include a plurality of apertures located along the arcuate path of the parabola. Weights of various mass, size and shape may be placed in any number of the plurality of apertures and secured to the club head. The weights placed along the arcuate parabolic path allow the golfer to customize the MOI, CG, overall mass of the club head and other club head features for a specific swing. The plurality of apertures may be visible or concealed from view when the golfer is in the normal address position.

Additionally, the weights may be substantially parabolic in shape and consist of a single parabolic weight, several thin parabolic weight plates, or a parabolic weight cartridge. These parabolic weight styles may utilize a variety of materials allowing golfers to significantly vary club head mass, MOI, and CG. The single parabolic weight provides a consistent weight throughout the parabolic volume and may serve to concentrate the weight near the arcuate parabolic path.

The parabolic weight plates may serve to provide weight "layering" from the top region to the sole region. The parabolic weight plates allow the golfer to concentrate weight near the top region, sole region, or somewhere in between based on material composition and density of each parabolic weight plate.

The parabolic weight cartridge may receive many smaller weights held within pockets bored into the weight cartridge. The entire assembly is installed in a mating parabolic slot located in the club head and the weight cartridge is secured to the club head with fasteners. The parabolic weight cartridge allows weight adjustment in all planes from heel region, toe region, top region, sole region or anywhere in between based on weight density and placement locations within the parabolic weight cartridge.

The combination of parabolic club head geometry, with the face located at the directrix and shaft located at the focus allows golfers to create a very light club head without sacrificing stability and forgiveness. A lighter club head moves the CG closer to the butt end of the grip creating a simulated "anchored" putting stroke feel. Additionally, the combination of the parabolic head, weight adjustment opportunities, hosel and face customization options allow golfers to attain a golf club truly customized by them with broad performance characteristics suiting all styles and levels of play.

BRIEF DESCRIPTION OF THE DRAWINGS

In the drawings, closely related figures have the same number but different alphabetic suffixes.

FIG. 12A is a bottom front perspective view illustrating a plurality of weight pockets concealed in the sole region of a club head in accordance with one alternative embodiment.

FIG. 12B is a bottom view illustrating a plurality of weight pockets and attachment features concealed in the sole region of a club head in accordance with one alternative embodiment.

FIG. 12C is a bottom front perspective view illustrating a parabolic weight receiving bore concealed in the sole region of a club head in accordance with one alternative embodiment.

FIG. 12D is a bottom view illustrating a parabolic weight receiving bore concealed in the sole region of a club head in accordance with one alternative embodiment.

FIG. 14A is a bottom perspective view illustrating a parabolic weight and attachment features in accordance with one alternative embodiment.

FIG. 14B is a top perspective view illustrating a parabolic weight and attachment features in accordance with one alternative embodiment.

FIG. 14C is a top perspective view illustrating a plurality of parabolic mass insert plates and parabolic mass base plate with attachment features in accordance with one alternative embodiment.

FIG. 14D is a bottom perspective view illustrating a parabolic mass base plate with attachment features in accordance with one alternative embodiment.

FIG. 15A is a bottom perspective view illustrating a parabolic weight cartridge and attachment features in accordance with one alternative embodiment.

FIG. 15B is a top perspective view illustrating a parabolic weight cartridge and attachment features in accordance with one alternative embodiment.

FIG. 15C is a top perspective view illustrating a solid weight and attachment features in accordance with one alternative embodiment.

FIG. 15D is a top perspective view illustrating an alignment bore weight and attachment features in accordance with one alternative embodiment.

FIG. 15E is a bottom perspective view illustrating an alignment bore weight and attachment features in accordance with one alternative embodiment.

FIG. 16A is an bottom exploded view illustrating club head assembly with concealed weights disposed along a parabolic path in the sole region of a club head and used to explain the operation in accordance with one alternative embodiment.

FIG. 16B is an top exploded view illustrating club head assembly with concealed weights disposed along a parabolic path in the sole region of a club head and used to explain the operation in accordance with one alternative embodiment.

FIG. 16C is a bottom view illustrating a plurality of weight pockets and attachment features concealed in the sole region of a club head in accordance with one alternative embodiment.

FIG. 17A is an bottom exploded view illustrating club head assembly with concealed parabolic weight disposed in the sole region of a club head and used to explain the operation in accordance with one alternative embodiment.

FIG. 17B is an top exploded view illustrating club head assembly with concealed parabolic weight disposed in the sole region of a club head and used to explain the operation in accordance with one alternative embodiment.

FIG. 17C is a bottom view illustrating a parabolic weight receiving bore concealed in the sole region of a club head in accordance with one alternative embodiment.

FIG. 18A is a top exploded view illustrating club head assembly with concealed parabolic weight cartridge disposed in the sole region of a club head and used to explain the operation in accordance with one alternative embodiment.

FIG. 18B is a bottom exploded view illustrating club head assembly with concealed parabolic weight cartridge disposed in the sole region of a club head and used to explain the operation in accordance with one alternative embodiment.

FIG. 18C is a bottom view illustrating a parabolic weight receiving bore concealed in the sole region of a club head in accordance with one alternative embodiment.

DETAILED DESCRIPTION

Advantages

Accordingly several advantages of one or more aspects are as follows: to utilize parabolic properties by engineering the placement of the face and shaft at the directrix and focus, respectively of a parabolic path reducing the tendency of the club head to twist on off-center hits; to provide a club head geometry utilizing a parabolic path where weights may be installed, removed and interchanged from locations along the parabolic path to allow overall mass, MOI and CG adjustment, allowing multi-dimensional weight adjustment beyond moving weights along linear paths; to provide customization options appealing to a wide array of golfers such as club face inserts, club face patterns, interchangeable hosels, adjustable weights to alter MOI, CG, overall golf club mass and allow golfers the flexibility to test weight configurations to best compliment individual swings styles and weighting adjustments; to provide a lightweight and stable club head moving the CG upward toward the grip end to simulate an anchored putting stroke. These and other benefits of one or more aspects will be apparent from a consideration of the ensuing description and drawings.

Figure 1A:
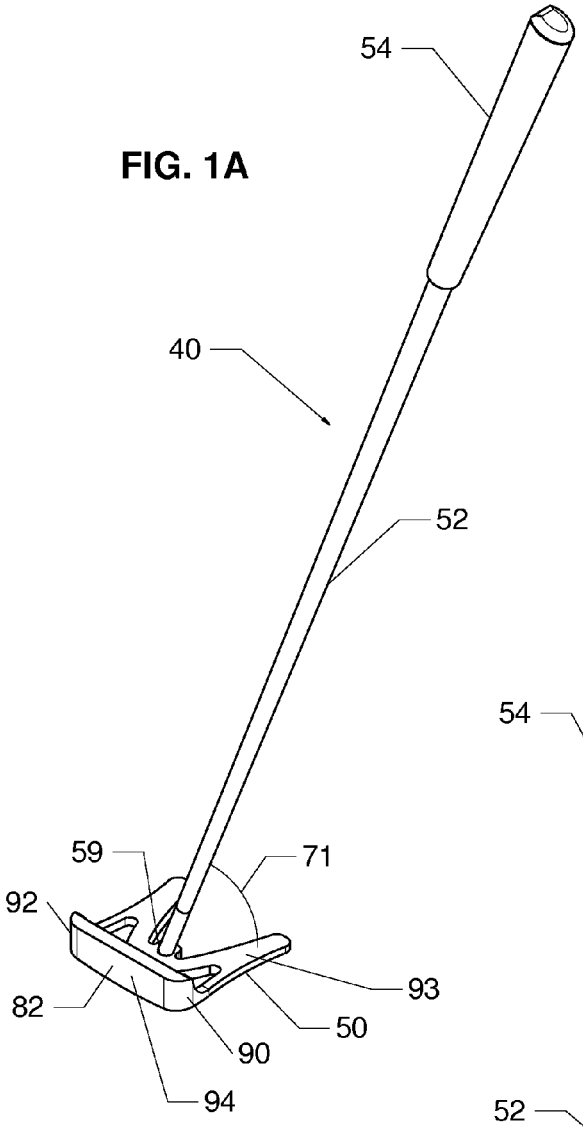
FIG. 1A is a perspective view illustrating a golf club in a right hand configuration in accordance with one embodiment.
Figure 1B:
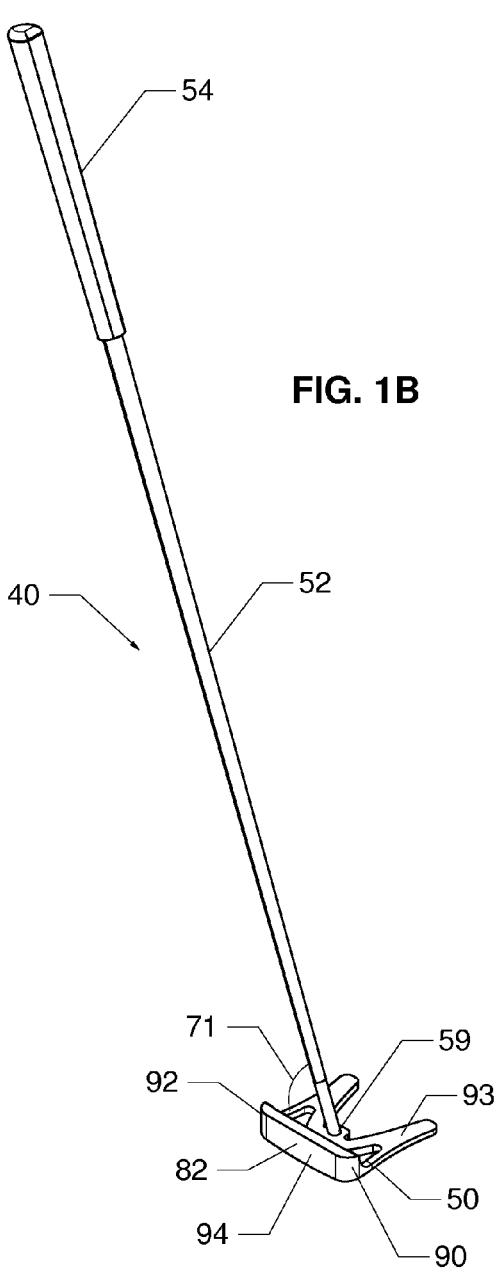
FIG. 1B is a perspective view illustrating a golf club in a left hand configuration in accordance with one embodiment.
Figure 1C:
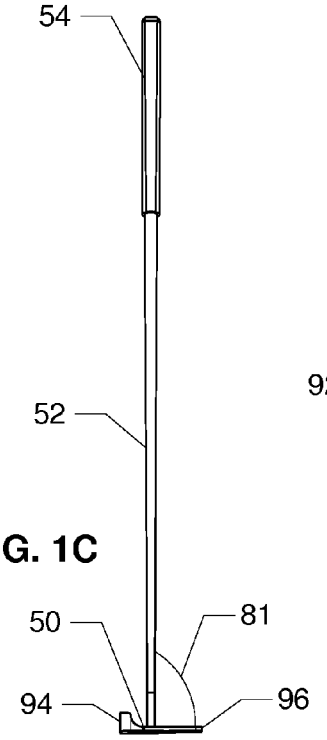
FIG. 1C is a perspective back view illustrating a golf club and a shaft loft angle in accordance with one embodiment.

Golf Club Embodiment—FIGS. 1A Through 1C

Figure 2A:
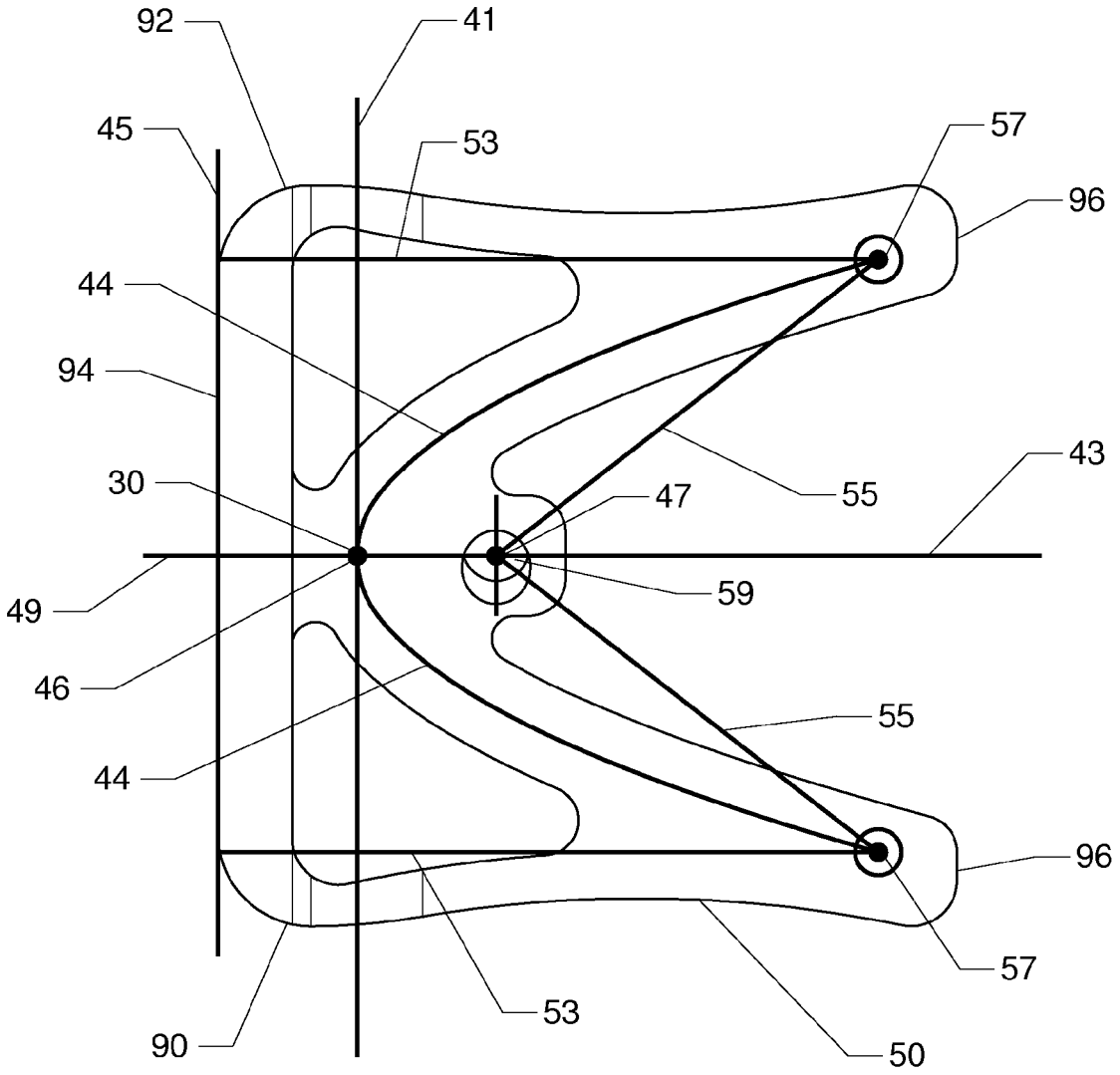
FIG. 2A is a detail top view illustrating parabolic features layered on a club head in accordance with one embodiment.

One embodiment of a golf club 40 is illustrated in FIGS. 1A through 1C (perspective views and side view, respectively). Golf club 40 contains a grip 54, a shaft 52, a club head 50, a face region 94, and a hosel 59. Golf club 40 is illustrated in a right-hand configuration (FIG. 1A) and a left-hand configuration (FIG. 1B). Club head 50 is configured to follow a substantially parabolic path 44 (FIG. 2A). Club head 50 utilizes the reflective properties of a parabola by positioning hosel 59 at a focus 47 (FIG. 2A) to join club head 50 to shaft 52. Additionally, club head 50 utilizes the reflective properties of a parabola by positioning face region 94 at a directrix 45 (FIG. 2A).

Grip 54 is attached to the proximal end of shaft 52. Grips commonly comprise a D-shape with a flat portion approximately perpendicular to face region 94 and a rounded section located behind the flat grip portion. An internal bore, located longitudinally within grip 54 matches the outer shaft 52 diameter at the proximal end allowing grip 54 to slide over shaft 52. Grip 54 may consist of a rubber, leather, urethane or other suitable material easily formed, cast, or machined to shape. Grip 54 shape, size, design, color, configurations and materials are readily known to those skilled in the art and available from numerous manufacturers and retail outlets.

Shaft 52 consists of a distal end, opposite grip 54 end, where shaft 52 attaches to club head 50. Shaft 52 is disposed in hosel 59 located at focus 47 (FIG. 2A). Shaft 52 may form a lie angle 71 between shaft 52 and top region 93. Lie angle 71 is measured parallel to the major axis as illustrated in FIGS. 1A and 1B and positions the golfer in the heel/toe direction parallel to face region 94. Shaft 52 may tilt toward heel region 90 for a right hand configuration (FIG. 1A). Shaft 52 lie angle 71 may tilt toward toe region 92 for a left hand configuration (FIG. 1B). Lie angle 71 may be completely horizontal (90 degrees), completely vertical (0 degrees) or angled anywhere between the vertical and horizontal positions. The USGA allows for lie angle 71 to be at least 10-degrees from the vertical with lie angle 71 between 10 degrees and 30 degrees being common. A selection of various lie angles 71 allows golfers to find a stance and hitting position to suit their individual playing style.

Shaft 52 may also form a shaft loft angle 81 between shaft 52 and top region 93. Shaft loft angle 81 may angle toward face region 94 and tail region 96. Shaft loft angle 81 may be completely horizontal (90 degrees), completely vertical (0 degrees) or angled anywhere between the vertical and horizontal positions. Shaft loft angle 81 of +/−5 degrees from vertical are common. Shaft loft angle 81 positions the golfer forward or rearward of hosel 59. Moving the golfer toward face region 94 and toward tail region 96 may improve alignment position and increase accuracy. Additionally, shifting the sight line of a golfer toward face region 94 and toward tail region 96 may improve club alignment with the golf ball and target by better accommodating individual sight conditions.

Shaft 52 generally consists of a smooth hollow bore and a tapered exterior with the proximal end having a larger outer diameter than the distal end. Shaft 52 is substantially rigid, may have a smooth taper, stepped taper or a combination thereof. Shaft 52 may consist of steel, graphite, aluminum, fiber reinforced plastics or other suitable material easily formed, cast, or machined into shape. Shaft 52 shape, size, design, color, configurations and materials are readily known to those skilled in the art and available from numerous manufacturers and retail outlets.

Parabolic Features of Club Head—FIG. 2A

One embodiment of club head 50 is illustrated in FIG. 2A (Top View) with parabolic features illustrated as darker lines drawn on club head 50. Club head 50 consists of a parabolic path 44 symmetrically located about a horizontal axis known as an axis of symmetry 43, a face region 94 located at directrix 45 and hosel 59 located at focus 47. Axis of symmetry 43 may be co-linear to a reference axis known as a X-axis 49. Axis of symmetry 43 may remain parallel to X-axis 49 and be offset a distance above or below X-axis 49. Parabolic path 44 is located half above and half below axis of symmetry 43 or simply stated, parabolic path 44 is symmetrical about axis of symmetry 43. The symmetry of parabolic path 44 produces a balanced condition along the length of club head 50. The balanced condition helps golfers make consistent swings while keeping face region 94 square to the intended target throughout the swing and impact with a golf ball.

The point where parabolic path 44 intersects the axis of symmetry 43 is known as a vertex 46. Vertex 46 may be located at the intersection of X-axis 49 and a second axis perpendicular to X-axis 49 known as a Y-axis 41. The intersection of X-axis 49 and Y-axis 41 is known as an origin 30. In one embodiment vertex 46 may be located at origin 30. In another embodiment vertex 46 may be offset a distance from origin 30 along x-axis 49, along y-axis 41 or along some combination of both x-axis 49 and y-axis 41. Vertex 46 is equidistant between focus 47 and directrix 45.

Focus 47 in combination with directrix 45 help define parabolic path 44. Focus 47 and directrix 45 are both equidistant from vertex 46 when measured along axis of symmetry 43. Directrix 45 is located on face region 94 side of vertex 46 and focus 47 is located on tail region 96 side of vertex 46. In one embodiment, focus 47 is co-located along axis of symmetry 43 a defined distance behind vertex 46. In one embodiment the distance between vertex 46 and focus 47 is 0.750 inches. Distances between vertex 46 and focus 47 may range from approximately 0.100 inches to at least 1.000 inch.

Face region 94 is located at directrix 45 parallel to Y-axis 41 and perpendicular to axis of symmetry 43 a defined distance in front of vertex 46. In one embodiment, the distance between vertex 46 and directrix 45 is 0.750 inches. In practice, distances between vertex 46 and directrix 45 may range from 0.100 inches to at least 1.000 inch provided it is equal to the distance between vertex 46 and focus 47 discussed earlier. Although directrix 45 may be infinite in length, in practice face region 94 width has a finite length. In one embodiment face region 94 width is 4.000 inches. Face region 94 width may range from approximately 2.000 inches to at least 6.000 inches. It can be appreciated there are infinite locations for focus 47 and directrix 45.

Parabolic path 44 is determined by utilizing focus 47 and directrix 45 to plot a series of points. A primary parabolic distance 53 line is drawn parallel to axis of symmetry 43 starting from any point along directrix 45 or face region 94 extending toward tail region 96 a defined distance. A secondary parabolic distance 55 line equal in length to primary parabolic distance 53 line is drawn from focus 47 to a point where primary parabolic distance 53 and secondary parabolic distance 55 intersect. This intersection point defines one point along parabolic path 44 and is referred to as a parabolic intersection point 57. The process is repeated multiple times starting at different points along directrix 45 both on toe region 92 and heel region 90 side of axis of symmetry 43. It is helpful to select a point equidistant toward toe region 92 side and heel region 90 side of axis of symmetry 43 to help create parabolic path 44.

Since both primary parabolic distance 53 and secondary parabolic distance 55 are equal length, primary parabolic distance 53 line and secondary parabolic distance 55 line will meet half way between directrix 45 and focus 47 at vertex 46. Primary parabolic distance 53 and secondary parabolic distance 55 are both drawn along and co-linear with axis of symmetry 43. Primary parabolic distance 53 and secondary parabolic distance 55 are both equal length. Therefore, when primary parabolic distance 53 and secondary parabolic distance 55 are drawn along axis of symmetry 43 in opposite directions starting at vertex 46 they define the distance from vertex 46 to focus 47 and directrix 45.

The graphical process described above may be represented by a mathematical formula to plot a parabolic path 44. While formulas may help expedite the process of plotting a parabolic path 44 they are often confusing to the layperson. A sample parabolic formula for the examples provided above is as follows: $y^2=4*p*x$. In this equation "p" is the location of focus 47 and negative "−p" represents the location of directrix 45. The negative (−) sign for "−p" is to show the location is on the opposite side of vertex 46 as "p". In the present example vertex 46 of parabolic path 44 is located at origin 30. In one embodiment a value of +/−0.750 inches is selected for the variable "p" and "−p" respectively. The "y" value represents any point along directrix 45 and is the starting point for the primary parabolic distance 53 line discussed above. Once a "y" value and "p" value are selected, the equation is solved for the unknown "x" value. The equation can also be rearranged to more easily solve for the "x" value. The rearranged equation is $x=(y^2)/(4*p)$. This process is repeated to plot a sufficient number of points to create parabolic path 44. It can be appreciated the graphical approach discussed earlier is a simpler method to determine and plot parabolic path 44 for the layperson.

The features and procedures used to define parabolic path 44 help club head 50 resist twisting on off center ball strikes and help keep face region 94 square at impact. The equality between primary parabolic distance 53 and secondary parabolic distance 55 in combination with the location of face region 94 and hosel 59 locate the MOI and CG favorably to resist the twisting motion often felt on an off center ball strike. The reduction in twisting maintains a square face region 94 at impact reducing the likelihood of a pushed or pulled golf shot or putt.

Club Head Features—FIGS. 3A Through 3F

Figure 3A:
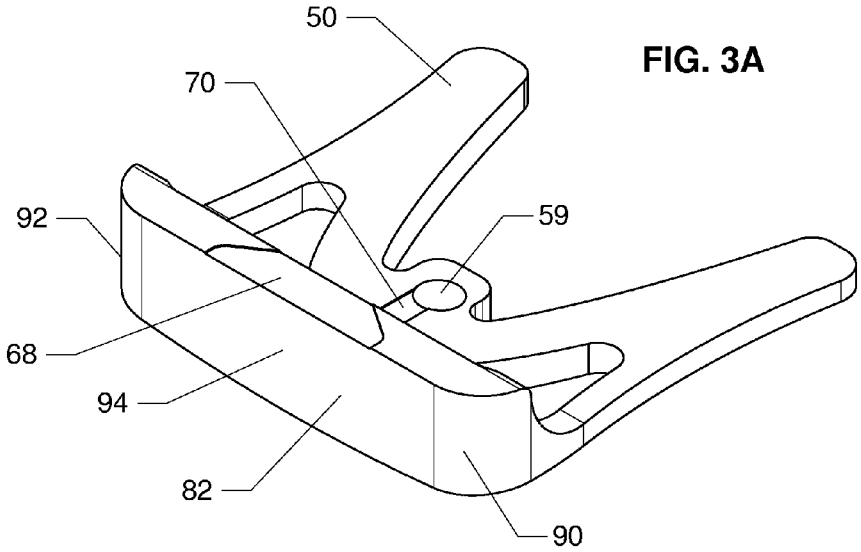
FIG. 3A is a perspective view illustrating a club head and club head features in accordance with one embodiment.

One embodiment shows a front-top perspective view of club head 50 illustrated in FIG. 3A. In one embodiment club head 50 and its features are CNC machined from 6061 aluminum. Club head 50 may be made from other materials able to be machined, cast, extruded, or otherwise formed into a complete club head 50 such as metals, polymers, stainless steel, brass, copper, polymers, composites, and other materials. Additionally, various combinations of the materials listed above may be combined to form club head 50. Further, club head 50 may be coated with a finish to provide corrosion resistance, color, and other aesthetic and performance enhancing characteristics. Coatings may include anodize, paint, powder coat, dyes, PVD, and other plating and coating options.

Hosel 59, illustrated in FIG. 3A, is located at focus 47 (FIG. 2A), and may consist of a bore or cavity drilled or formed into club head 50. Hosel 59 is drilled to a diameter equal to the outer diameter of distal end of shaft 52. Hosel 59 diameter allows a running fit or light press fit for the distal end of shaft 52. Shaft 52 may be secured to hosel 59 by brazing, soldering, mechanical fasteners and common club making adhesives. Those skilled in the art recognize the various epoxies and supplies available for shaft 52 attachment.

Hosel 59 may angle toward heel region 90 to create a right hand configuration illustrated in FIG. 1A. Hosel 59 may further be drilled into club head 50 at an angle toward toe region 92 to create a left-hand configuration illustrated in FIG. 1B. The angle toward heel region 90 and toward toe region 92 of hosel 59 determines lie angle 71. Additionally, hosel 59 may consist of a bore drilled into club head 50 angled toward face region 94 or angled toward tail region 96. The angle toward face region 94 and toward tail region 96 of hosel 59 determines shaft loft angle 81.

In one embodiment illustrated in FIG. 3A, a front sight aid 68 and rear sight aid 70 are co-located on club head 50. Front sight aid 68 and rear sight aid 70 help golfers align club head 50 with a golf ball providing a visual cue or indicator to center the golf ball between heel region 90 and toe region 92 on face region 94. Additionally, front sight aid 68 and rear sight aid 70 provide a means to square face region 94 to maintain its perpendicularity to the hole or target path. Front sight aid 68 and rear sight aid 70 may be approximately equal in width to a standard golf ball diameter.

In another embodiment, front sight aid 68 and rear sight aid 70 may consist of a thin line approximately 0.050 inches to 0.250 inch in width. Front sight aid 68 and rear sight aid 70 may consist of a thin line for golfers who draw lines around the equator of a golf ball for alignment purposes. Front sight aid 68 and rear sight aid 70 may consist of any geometric shape such as rectangles, triangles, parallelograms, polygons or any combination of geometric shapes. Further, front sight aid 68 and rear sight aid 70 may be equal in width, may be different widths, or the widths of each may vary along the length of front sight aid 68 and rear sight aid 70.

Front sight aid 68 and rear sight aid 70 may be various colors coated with a finish to provide corrosion resistance, color, and other aesthetic and performance enhancing characteristics. Coatings may include anodize, paint, powder coat, dyes, PVD, and other plating and coating options. Colors are chosen to contrast with color of club head 50. Colors such as white, yellow, and various fluorescent colors may be used to provide contrast and enable the golfer to distinguish front sight aid 68 and rear sight aid 70 from club head 50 and the various green colors found on golf courses.

Front sight aid 68 is located on a horizontal surface above face region 94 while rear sight aid 70 is located on a horizontal surface behind face region 94. Front sight aid 68 and rear sight aid 70 are both easily visible when the golfer is standing in a normal address position with eyes looking down at the top of club head 50. Front sight aid 68 and rear sight aid 70 are generally stepped to a shallow depth below the surrounding material. The sighting features should be stepped deep enough to distinguish them from the standard height of club head 50 but not stepped so deep they prove distracting to the user. A step depth between 0.010 and 0.050 inches provides a satisfactory depth.

One embodiment shown in FIG. 3A a front-top perspective view of club head 50 illustrates face region 94. Face region 94 is considered the flat surface located on a substantially vertical plane where the golf ball is impacted or struck. Face region 94 is located at directrix 45 of parabolic path 44 previously described and illustrated in FIG. 2A. In one embodiment face region 94 and its features are CNC machined from 6061 aluminum. Face region 94 may be made from other materials able to be machined, cast, extruded, or otherwise formed such as metals, polymers, stainless steel, brass, copper, polymers, and composites. Additionally, various combinations of the materials listed above may be combined to form club head 50 and face region 94.

Face region 94 may have a hardness with a durometer of 85 on the Shore A scale or greater as defined by the USGA. In one embodiment, face region 94 is contiguous with club head 50 and made from the same material as club head 50. Therefore, face region 94 and club head 50 may be a similar hardness. Further, face region 94 may be coated with a finish to provide corrosion resistance, color, and other aesthetic and performance enhancing coatings. Coatings may include anodize, paint, powder coat, dyes, PVD, and other plating and coating options.

Face region 94 helps golfers impart a rolling spin and forward momentum to set the ball in motion toward the hole. Face region 94 may help control the spin characteristics and feel depending on the material it is made from, the loft angle 75 and the pattern incorporated on face region 94. If face region 94 is made from a hard material such as aluminum or steel, the ball will tend to bounce off the face with more speed than if the face were made from a softer impact absorbing material. Therefore, if face region 94 is made from a hard material it may appeal to golfers who take a shorter stroke and often end up short of their target. If face region 94 is made from soft impact absorbing material it may appeal to golfers who take a longer stroke and tend to hit the ball too hard.

Figure 3B:
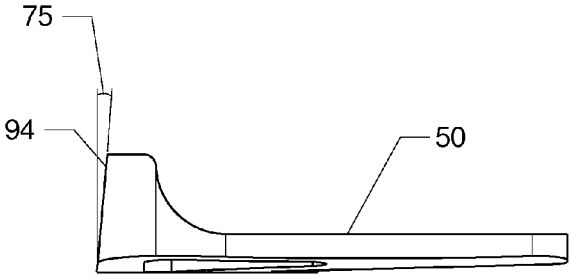
FIG. 3B is a side view illustrating a club head and face with a positive loft angle in accordance with one embodiment.
Figure 3C:
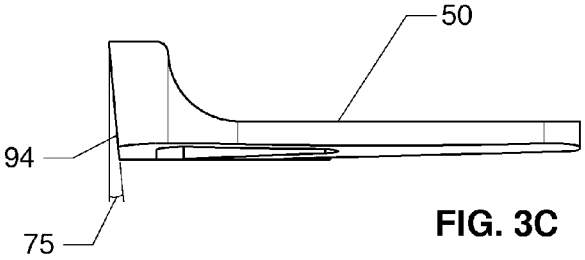
FIG. 3C is a side view illustrating a club head and face with a negative loft angle in accordance with one embodiment.

One embodiment, a side view of club head 50 shown in FIGS. 3B and 3C, illustrates face region 94 consisting of a loft angle 75. Loft angle 75 may be vertical (0°), angled upward (+5°) or downward (−5°) approximately between the angles listed. Loft angle 75 may be helpful if the ball is located on the fringe or just off the fringe in the rough. A positive, upward loft angle 75 illustrated in FIG. 3B helps to lift the golf ball with an upward trajectory launching the ball slightly into the air for a short distance to help the ball roll more consistently when it reaches a putting green or fairway.

Loft angle 75 may also be angled downward and may trap the ball between the green and face region 94 as illustrated in FIG. 3C. The downward loft angle 75 may impart different spin characteristics initially causing the golf ball, to bounce or skid. The golf ball may receive more top spin, back spin or may have very little spin initially. A rolling spin, either top spin or back spin, often helps the golf ball roll more efficiently on the intended line to the hole or cup.

Figure 3D:
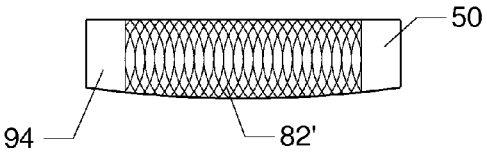
FIG. 3D is a front view illustrating a face region with a swirl groove pattern in accordance with one embodiment.
Figure 3E:
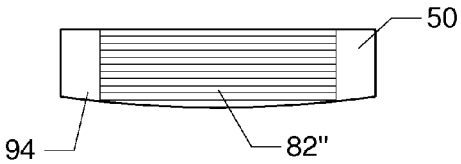
FIG. 3E is a front view illustrating a face region with a horizontal groove pattern in accordance with one embodiment.

Additionally, face region 94 may be smooth, consist of various grooves, patterns, dimples or other similar features. These features may be machined or engraved into face region 94 to promote spin and more consistent contact with the golf ball. Various examples of the features on face region 94 are illustrated in FIGS. 3A, 3D and 3E. The grooves and features disposed in face region 94 may be CNC machined, cast, extruded or otherwise formed or shaped. The grooves produce a rough surface able to grip the golf ball and produce spin when the ball is struck. Additionally, the irregular grooves and features provide recesses or voids improving the likelihood debris on the golf ball or face region 94 will not misguide the trajectory of the golf ball.

Face region 94, illustrated in FIG. 3A, consists of a smooth contact surface 82 serving as an impact location for a golf ball. Face region 94 consisting of smooth contact surface 82 may provide the golf ball with little to no spin when the ball is struck. Smooth contact surface 82 often provides forward momentum to the golf ball and the friction from the ground causes the golf ball to start spinning. Face region 94 may undergo a final finishing process to smooth any machining or casting marks.

Face region 94 is illustrated with a swirl groove pattern 82' in FIG. 3D. The swirl groove pattern produces a rough, irregular surface able to grip the golf ball and produce spin when the ball is struck. Additionally, the irregular surface provides additional forgiveness if debris or other foreign objects collect between face region 94 and golf ball. One method to achieve a swirl pattern is using a fly cutter and slowing the feed rate and rotational speed on a conventional or CNC milling machine. The ideal pattern may be found by experimenting with feed rates and rotational fly cutter speeds until an acceptable pattern is achieved.

Face region 94 is illustrated with a horizontal groove pattern 82" in FIG. 3E. Basic machining tools such as ball mills, engraving tools, lasers or similar tools may be used to create horizontal groove patterns 82". Multiple passes with a machining tool across the face produce furrows and lands to create horizontal groove patterns 82". Horizontal groove pattern 82" may provide improved spin characteristics for the golf ball similar to the grooves on iron type golf clubs. Some golfers may like spin on the golf ball to improve roll characteristics and improve ball direction and distance control.

It can be appreciated there are many face region 94, hosel 59, and front sight aid 68 and rear sight aid 70 material options, patterns, features, and configurations for golfers to enhance performance for their club head 50. The options vary between individual golfers, therefore, the specific design and configurations previously discussed should not limit the scope of this specification.

Operation—Embodiment—FIGS. 1A Through 3F

Golf club 40 is available in a right-hand (FIG. 1A) or left-hand configuration (FIG. 1B), depending on the individual golfer. Golf club 40 consists of grip 54 disposed on proximal end of shaft 52. Grip 54 is installed on shaft 52 by a grip tape using methods known to those skilled in the art. The distal end of shaft 52 is installed in hosel 59 disposed in club head 50. In one embodiment, shaft 52 and club head 50 are joined using club making epoxy and methods known to those skilled in the art. Additional joining methods may include mechanical fasteners, welding, brazing, and other methods.

Hosel 59 allows shaft 52 to angle toward heel region 90 or toe region 92 at various lie angles 71. Additionally, hosel 59 also allows shaft 52 to angle toward face region 94 or tail region 96 at various shaft loft angles 81. Various lie angles 71 and shaft loft angles 81 allow individual golfers to select a parabolic golf club system to fit their swing style and setup to achieve a substantially upright stance while swinging golf club 40.

The golfer rests sole region 91 on the ground in their setup position. The golfer grasps grip 54 utilizing their regular golf club or putting grip, depending on club head 50 type. The golfer aligns the front sight aid 68 (FIG. 3A) with the golf ball to center the ball on face region 94. The rear sight aid 70 (FIG. 3A) is aligned along the intended travel path of the golf ball. The golfer then finalizes positioning their feet, head and arms to align themselves with the golf club 40, golf ball and hole. It should be noted the setup and procedure discussed above will vary from golfer to golfer and is meant to generally illustrate a golfing setup.

Swing style varies depending on club head 50 type and golfer. If club head 50 is a wood type or iron type, the golfer swings the golf club 40 in a large arcing back swing with a large arcing follow through. If club head 50 is a putter type club head 50, the golfer uses golf club 40 with a short back swing and short follow through in a pendulum or slight arcing motion.

Face region 94 on golf club 40 contacts the golf ball on the forward swing sending the ball toward the hole. It is helpful to keep face region 94 substantially square to the golf ball and hole at impact. The parabolic shape of golf club 40 in combination with shaft 52 being placed at focus 47 (FIG. 2A) and face region 94 being placed at directrix 45 (FIG. 2A) substantially increases the opportunity for face region 94 to impact the golf ball squarely. A square face region 94 at impact reduces the likelihood of a pushed or pulled shot helping to lower golfing scores.

Face Configuration & Operation

One embodiment of golf club 40 allows golfers to select face region 94 with a plurality of loft angles 75. Face region 94 may consist of a positive loft or negative loft illustrated in FIGS. 3B and 3C, respectively. Loft angles 75 may impart various spin and roll characteristics to the golf ball with various loft angles 75 appealing to a wide variety of golfers. Loft angles 75 are permanently machined into face region 94 utilizing the methods and procedures previously discussed.

One embodiment of golf club 40 allows golfers to select from a plurality of face region 94 patterns. Face region 94 is the initial impact location for striking the golf ball and is located at directrix 45 of a parabolic path 44 (FIG. 2A). A golfer may choose a face region 94 made of the same material as club head 50 where face region 94 and club head 50 are a contiguous body. In one embodiment face region 94 may be smooth with no features or patterns machined on face region 94 surface. A smooth contact surface 82 (FIG. 3A) may appeal to some golfers instead of swirl groove pattern 82' (FIG. 3D) and horizontal groove pattern 82" (FIG. 3E).

A golfer is able to select golf club 40 with a variety of features and patterns to satisfy their style of play. The features and patterns added are permanently integrated into golf club 40. Given the variety of features and patterns available, the examples presented in the specification should not be used to limit the scope.

Figure 4A:
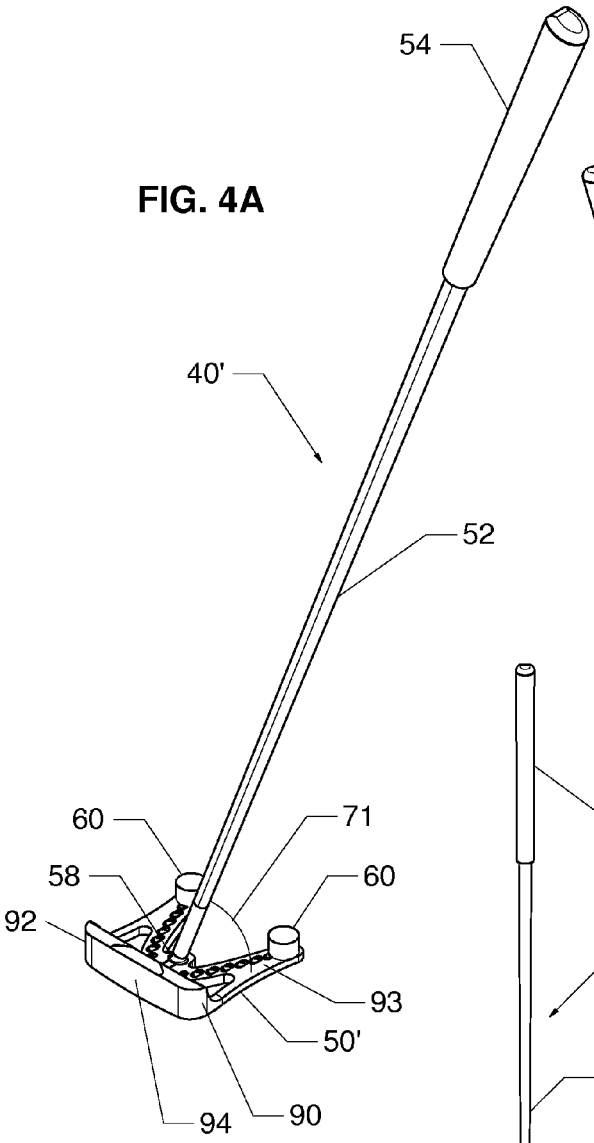
FIG. 4A is a perspective view illustrating a golf club in a right hand configuration with a plurality of weight locking pockets and weights disposed along a parabolic path in accordance with one alternative embodiment.
Figure 4B:
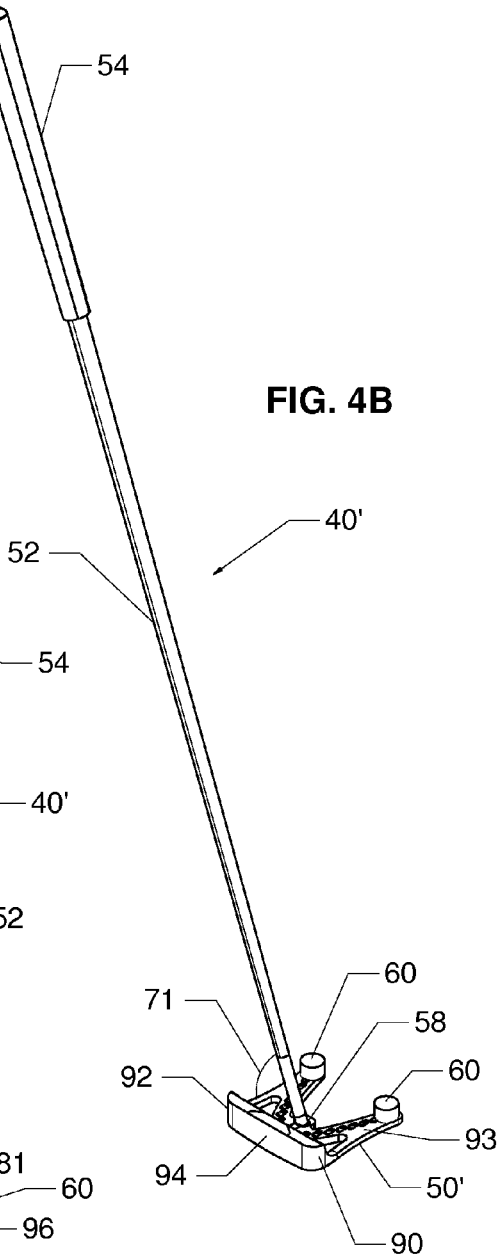
FIG. 4B is a perspective view illustrating a golf club in a left hand configuration with a plurality of weight locking pockets and weights disposed along a parabolic path in accordance with one alternative embodiment.

Alternative Club Embodiment—FIGS. 4A-4B

Figure 4C:
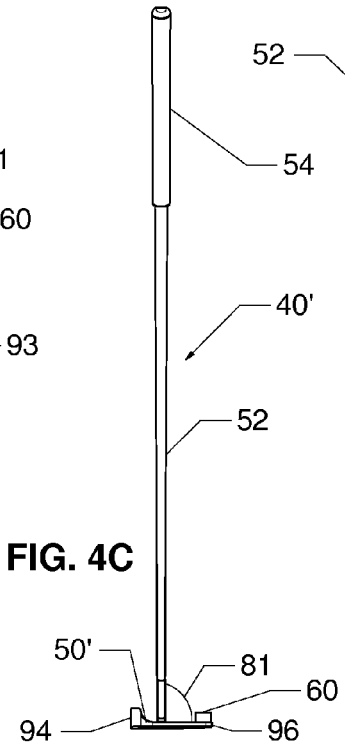
FIG. 4C is a back view illustrating a golf club and a shaft loft angle with a plurality of weight locking pockets and weights disposed along a parabolic path in accordance with one embodiment.

One alternative embodiment of a golf club 40' is illustrated in FIGS. 4A through 4C (perspective views and side view, respectively). Club head 50' is configured with a plurality of apertures to position at least a single weight 60 selected from a plurality of weight 60 options (FIGS. 7A through 7D) along parabolic path 44 (FIG. 2A). Additionally, club head 50' may further be configured by selecting a interchangeable hosel 58 from a plurality of interchangeable hosel 58 options (FIGS. 8A through 8F). Club head 50' may further be configured by selecting a face insert 56 from a plurality of face insert 56 options (FIGS. 6B through 6D). Golf club 40' may still consist of grip 54, shaft 52, face region 94, hosel 59, front sight aid 68' and rear sight aid 70' as discussed in previous embodiments.

Figure 5A:
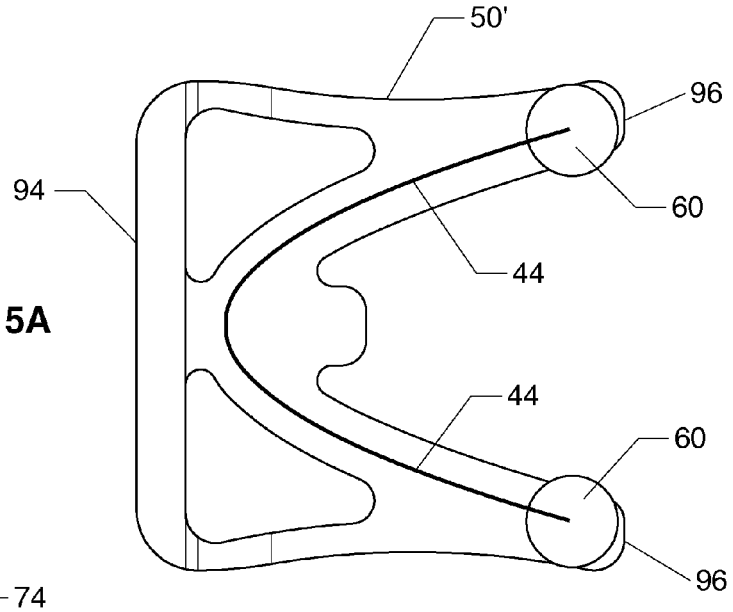
FIG. 5A is a detail top view illustrating weights disposed along a parabolic path layered on a club head in accordance with one alternative embodiment.
Figure 5B:
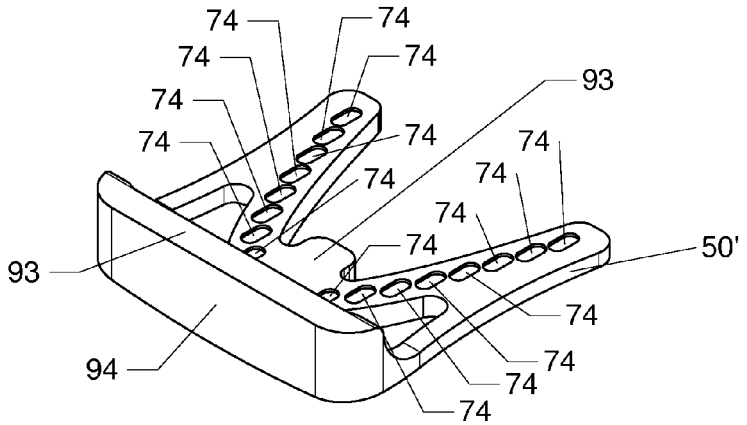
FIG. 5B is a top perspective view illustrating weight locking pockets disposed along a parabolic path in accordance with one alternative embodiment.

Weight Aperture Club Head Embodiments—FIGS. 5A-5B

A top view of one alternative embodiment in FIG. 5A illustrates two weight(s) 60 disposed along parabolic path 44. Weights 60 are located behind face region 94 near tail region 96 of club head 50'. The addition of at least one weight 60 along parabolic path 44 allows golfers to alter MOI, CG, and overall mass of putter head 50' providing additional flexibility, customization, and performance to meet their individual golfing style.

A plurality of apertures or weight locking pockets 74 are illustrated in FIG. 5B. The plurality of apertures may consist of a hole and may be formed by a pair of slots with teeth extending inwardly allowing for improved weight 60 positioning. Weight locking pockets 74 are added to club head 50' and positioned along parabolic path 44 (FIG. 5A). In one embodiment weight locking pockets 74 are oblong and located on top region 93 of club head 50' behind face region 94. Weight locking pockets 74 have a major axis that is greater than the minor axis (i.e. length is greater than width). Weight locking pockets 74 may be CNC machined to a depth less than the overall club head 50' height creating a blind cavity approximately between 0.020 and 0.100 inch in depth. Weight locking pockets 74 may also be cast, extruded, or otherwise formed into any of an infinite number of shapes or configurations. Weight locking pockets 74 may consist of additional shapes or utilize other features to securely hold weight 60 (FIGS. 7A through 7D) in a predetermined and stationary position during assembly. Shapes such as triangles, squares, star-shapes, and others may be utilized to secure and position weight 60 (FIGS. 7A through 7D) in a non-rotating fashion.

Figure 5C:
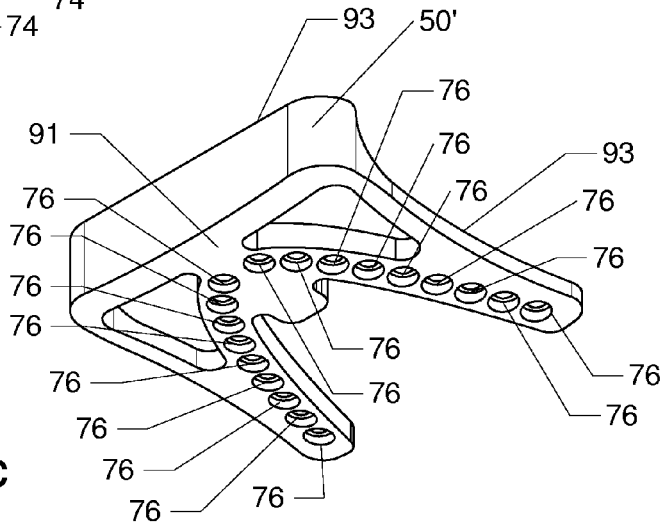
FIG. 5C is a bottom perspective view illustrating weight fastener cavities disposed along a parabolic path in accordance with one alternative embodiment.

A plurality of weight fastener cavities 76 are best illustrated by the bottom-front perspective view in FIG. 5C. The center points of weight fastener cavities 76 are disposed along parabolic path 44 (FIG. 5A) and centered in each corresponding weight locking pocket 74. Weight fastener cavities 76 may be CNC machined as a counter-bore, counter-sink or other hole type to provide a recess for the selected fastener heads. Weight fastener cavities 76 consist of a primary bore and a secondary bore. The primary bore is approximately equal in diameter and depth to a fastener head and provides a recess to conceal fastener head. The primary bore extends partially into sole region 91 of club head 50' and does not penetrate weight locking pocket 74 (FIG. 5B). The secondary bore is approximately equal in diameter to the fastener body. The secondary bore, located co-axially and concentrically to the primary bore, passes through top region 93 of club head 50'. The secondary bore is drilled along a vertical axis from sole region 91 through top region 93 of club head 50' exiting through the center of weight locking pocket 74 (FIG. 5B).

Figure 6A:
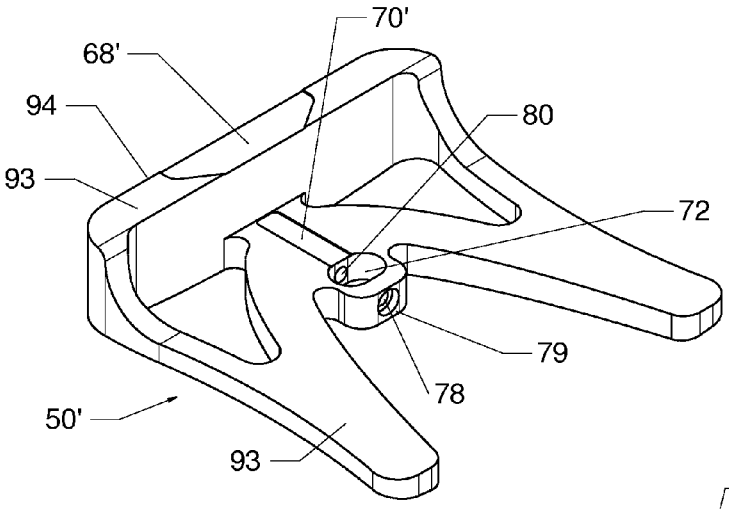
FIG. 6A is a back top perspective view illustrating a hosel installation pocket and hosel fastening holes in accordance with an alternative embodiment.
Figure 6B:
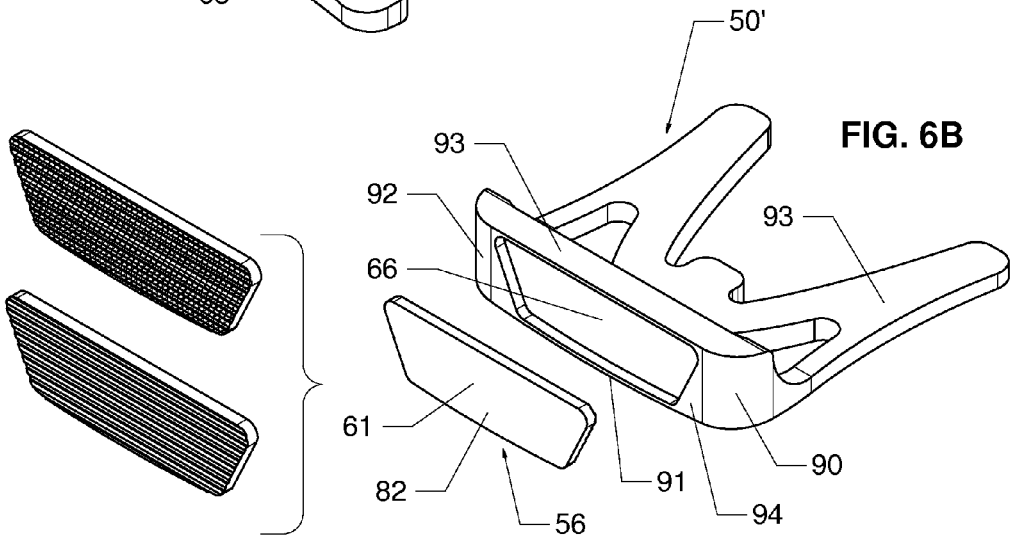
FIG. 6B is a front top perspective view illustrating a face insert with a smooth contact surface in accordance with another alternative embodiment.
Figure 6C:
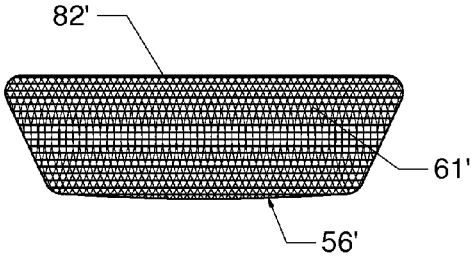
FIG. 6C is a front view illustrating a face insert with a swirl groove pattern located on a planar striking surface in accordance with one alternative embodiment.
Figure 6D:
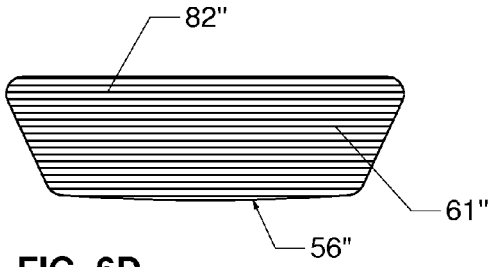
FIG. 6D is a front view illustrating a face insert with a horizontal groove pattern located on a planar striking surface in accordance with one alternative embodiment.

Club Head Interchangeable Hosel Embodiments—FIG. 6A

A top-back perspective view of one alternative embodiment shown in FIG. 6A illustrates a hosel installation pocket 72, an outer hosel fastener hole 78, and an inner hosel fastener hole 80. Hosel installation pocket 72 is machined into club head 50' at focus 47 (FIG. 2A) of parabolic path 44 (FIG. 2A). Hosel installation pocket 72 may be CNC machined, cast, extruded, or otherwise formed into club head 50' in a variety of shapes and configurations. Additionally, hosel installation pocket 72 may be may be oblong with a major axis greater in length than the minor axis (i.e. length is greater than width). Hosel installation pocket 72 may be between 0.100 and 0.750 inches in depth and is substantially shallower than overall club head 50' height, creating a blind cavity.

Outer hosel fastener hole 78 is perpendicular to face region 94 and bored from a outer vertical wall 79 into hosel installation pocket 72. Outer hosel fastener hole 78 consists of a primary bore and a secondary bore. The primary bore is approximately equal in diameter and depth to a fastener head and provides a recess to conceal fastener head. The primary bore extends partially into outer vertical wall 79 of club head 50' and does not penetrate hosel installation pocket 72. The secondary bore is approximately equal in diameter to the fastener body. The secondary bore, located co-axially and concentrically to the primary bore, starts at outer vertical wall 79, continues through hosel installation pocket 72 into a second vertical wall opposite outer vertical wall 79 within hosel installation pocket 72 creating an inner hosel fastener hole 80. Inner hosel fastener hole 80 is co-axially and concentrically located with outer hosel fastener hole 78. Inner hosel fastener hole 80 is designed to receive a mechanical fastener such as a cap screw and therefore may be threaded or un-threaded. Inner hosel fastener hole 80 is drilled to a depth to provide thread engagement or additional clearance for fastener body.

Club Head Face Insert Embodiments—FIG. 6B-6D

A perspective view showing an alternate embodiment representing a club head 50' configured to accept a face insert 56 is illustrated in FIG. 6B. Club head 50' may contain a pocket or a face insert cavity 66 located within face region 94 it as illustrated in FIG. 6B. Face insert cavity 66 may be CNC machined, cast, extruded or otherwise formed or shaped into face region 94. Face insert cavity 66 may consist of any geometric shape such as a rhomboid, rectangle, square, circle, triangle, parallelogram, and other shapes and combinations of geometric shapes. In one embodiment the bottom of face insert cavity 66 consists of an arcuate shape to match the arcuate shape of sole region 91. Face insert cavity 66 may be symmetrically located between heel region 90 and toe region 92. Face insert cavity 66 may or may not be completely contained between top region 93 and sole region 91. Additionally, face insert cavity 66 may extend outside face region 94 boundary defined by heel region 90, toe region 92, top region 93, sole region 91.

Face insert cavity 66 may vary in depth depending on the thickness of face insert 56 used. Face insert cavity 66 may vary in depth between 0.050 and 0.375 inches or greater. Maximum face insert cavity 66 depth depends on overall club head 50' face region 94 thickness. The overall width and height of face insert cavity 66 may vary depending on overall club head 50' dimensions and contact area for face insert 56.

Face insert 56 may be made from any material and material combinations such as metals, polymers, stainless steel, brass, copper, polymers, composites, and materials with various coatings. A number of fabrication processes may be used to form the materials including CNC machining, casting, extrusions and other forming and shaping processes through additive and subtractive methods. In one embodiment, face insert 56 is machined or otherwise formed to be disposed in face insert cavity 66 contained on club head 50'.

Face insert 56 may consist of any geometric shape such as a rhomboid, rectangle, square, circle, triangle, parallelogram, and other shapes and combinations of geometric shapes to precisely match the shape of face insert cavity 66. Face insert 56 allows a golfer to select from a variety of materials and material combinations such as aluminum, steel, urethane, composites, plastics and other materials. The materials may further consist of various hardness and colors in addition to other physical and aesthetic properties. Further, face insert 56 may be coated with a finish to provide corrosion resistance, color, and other aesthetic and performance enhancing characteristics. Coatings may include anodize, paint, powder coat, dyes, PVD, and other plating and coating options.

Various patterns may be formed or machined into face insert 56 as illustrated in FIGS. 6B through 6D and discussed in the following section. Face insert 56 allows golfers to select from a variety of patterns and helps the golfer impart a rolling spin and forward momentum to set the ball in motion toward the hole. Face insert 56 may help control the spin characteristics and feel depending on the material it is made from and the pattern incorporated on the planar striking surface 61. When the golfer swings the club, the ball is impacted by face insert 56. If face insert 56 is made from a hard material such as aluminum or steel, the ball will tend to bounce off the face with more speed than if the face were made from a softer impact absorbing material. Therefore, if face insert 56 is made from a hard material will appeal to golfers who take shorter, less powerful swings. A face insert 56 made from soft impact absorbing material will appeal to golfers who take longer, more powerful swings. It can be appreciated there are nearly an infinite number of face insert 56 material options for golfers to enhance performance for their ball striking tempo and style. Allowing golfers the ability to select from a variety of face inserts 56 helps golfers create a club to best fit their ability and playing style.

Face insert 56 illustrated in FIG. 6B consists of a planar striking surface 61 with a smooth contact surface 82 serving as an impact location for a golf ball. Face insert 56 with a smooth contact surface 82 may provide the golf ball with little to no spin when the ball is struck. Smooth contact surface 82 often provides forward momentum to the golf ball and the friction from the ground causes the golf ball to start rolling. Smooth contact surface 82 on face insert 56 may be CNC machined or cast with a final finishing process to smooth any machining or casting marks.

An alternate embodiment for a face insert 56' is illustrated with a swirl groove pattern 82' in FIG. 6C. Swirl groove pattern 82' produces a rough, irregular surface able to grip the golf ball and produce spin when the ball is struck. Swirl groove pattern 82' provides furrows improving the likelihood debris on the golf ball and planar striking surface 61' will not misguide golf ball trajectory. Swirl groove pattern 82' is disposed on face insert 56' which may be removed from face region 94 and club head 50'. Swirl groove pattern 82' on face insert 56' is achieved in a similar manner to swirl groove pattern 82' (FIG. 3E) relating to face region 94 in previous embodiments.

Another alternate embodiment for a face insert 56" is illustrated with a horizontal groove pattern 82" in FIG. 6D. Horizontal groove pattern 82" produces a rough, irregular surface able to grip the golf ball and produce spin when the ball is struck, similar to the grooves found on iron type club heads. Horizontal groove pattern 82" is disposed on face insert 56' which may be removed from face region 94 and club head 50'. Horizontal groove pattern 82" on face insert 56' is achieved in a similar manner to horizontal groove pattern 82" (FIG. 3F) relating to face region 94 in previous embodiments.

It is understood additional materials and grooves, patterns, dimples or other similar features may be incorporated into face insert 56. Grooves machined into face insert 56 may be horizontal, vertical, circular, crossed circular and are as individual as the golfers playing the game. The variety of face insert 56 patterns in combination with materials, hardness and other physical properties allows golfers to customize the feel and feedback characteristics of a particular club head 50 to suit their individual style of play.

Weight Embodiments—FIGS. 7A-7D

Figure 7A:
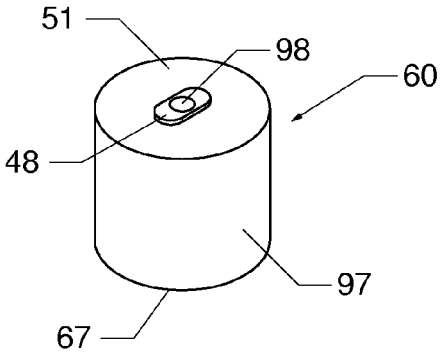
FIG. 7A is a bottom perspective view illustrating a weight and attachment features in accordance with one embodiment.
Figure 7B:
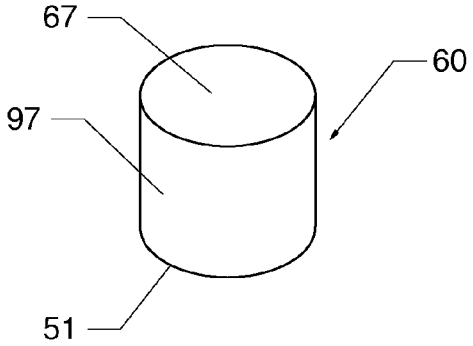
FIG. 7B is a top perspective view illustrating a weight in accordance with one alternative embodiment.

Weight 60 is illustrated in FIGS. 7A and 7B in a perspective view. Weight 60 is shown as a cylinder but may consist of any geometric shape such as rectangular, triangular, polygon prisms, pyramids, cones or spheres, or other three dimensional geometric solids. Weight 60 may be made from any material such as metals, polymers, stainless steel, brass, copper, polymers, composites, tungsten, or materials with various coatings. A number of fabrication processes may be used to form the materials including CNC machining, casting, extrusions, sintering and other additive or subtractive methods. Weight 60 may be made from materials with higher density than club head 50' material allowing golfers to more significantly alter the MOI, CG, and overall club head 50' mass properties.

Further, weight 60 may be coated with a finish to provide corrosion resistance, color, and other aesthetic and performance enhancing coatings. Coatings may include anodize, paint, powder coat, dyes, PVD, and other plating and coating options.

The combination of material density, shape, and volume of weight 60 determines the overall mass. The mass of a single weight 60 may vary between a few grams or exceed several hundred grams with the mass generally remaining between 10 grams and 75 grams. Overall weight 60 dimensions vary widely and correspond to shape, material and the design mass. Weight 60 dimensions may vary between 0.375 and 1.000 inches in width and diameter, with height dimensions varying between 0.250 and 1.500 inches depending on weight geometry. It should be noted weight 60 mass and dimensions vary significantly and depend on club head 50' dimensions and the individual golfer.

Figure 9A:
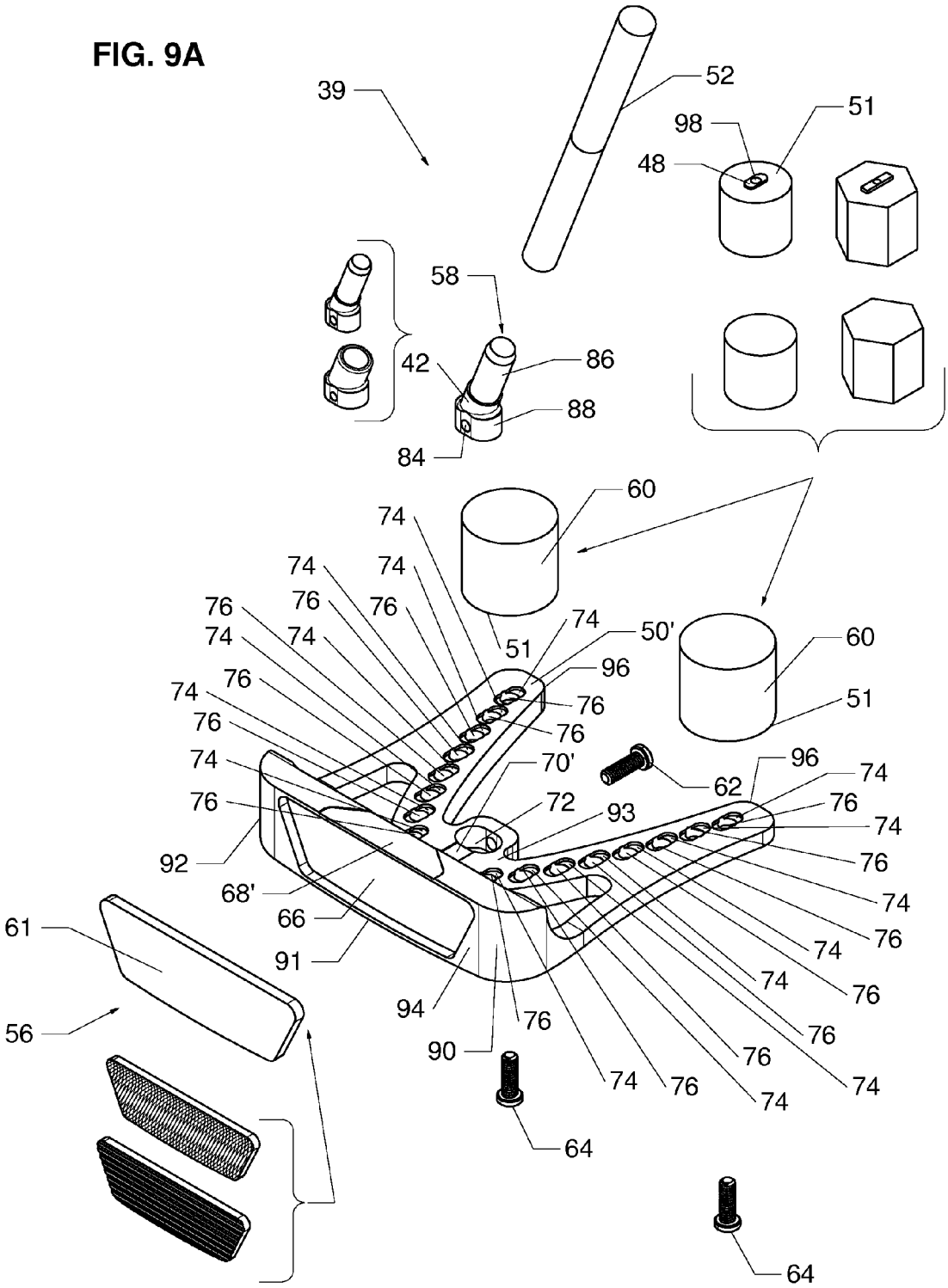
FIG. 9A is an exploded view illustrating club head assembly and used to explain the operation in accordance with one alternative embodiment.

In one embodiment illustrated in FIGS. 7A and 7B, weight 60 consists of a cylindrical portion or weight body 97 and weight top 67 opposite weight base 51. Weight base 51 and weight top 67 form the ends of the cylinder. Weight base 51 contains a weight locking boss 48, oblong in shape, to prevent weight 60 from rotating during installation. Weight locking boss 48 may constitute any shape such as rectangles, trapezoids, star-shapes or other geometric shapes to keep weight 60 from rotating when weight locking boss 48 is engaged in weight locking pockets 74 (FIG. 5B). A weight locking hole 98, is drilled axially starting at weight locking boss 48 and continuing toward weight top 67 some distance into weight body 97. Weight locking hole 98 may be a blind or through hole that is threaded or provided with other means to receive a weight fastener 64 (FIG. 9A).

Figure 7C:
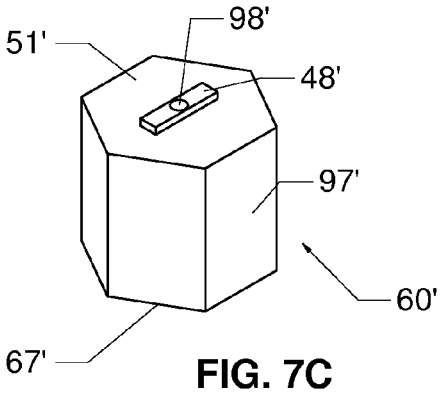
FIG. 7C is a bottom perspective view illustrating a weight and attachment features in accordance with one alternative embodiment.
Figure 7D:
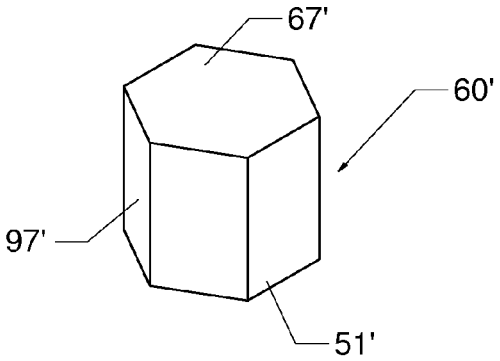
FIG. 7D is a bottom perspective view illustrating a weight and attachment features in accordance with one alternative embodiment.

An alternative embodiment of a weight 60' is illustrated in FIGS. 7C and 7D and provides an example of alternative weight shapes. The alternative geometry consists of a weight body 97' with a hexagonal shape and a rectangular shaped weight locking boss 48' to prevent weight 60' from rotating during installation. Weight locking boss 48' is disposed on weight base 51' with a weight locking hole 98' centered in weight body 97' and drilled axially from weight base 51' toward weight top 67'. The features, shapes, configuration, fabrication methods, and materials of alternative embodiment of weight 60' are similar to weight 60 described in other embodiments.

Interchangeable Hosel Embodiments—FIGS. 8A Through 8F

Figure 8A:
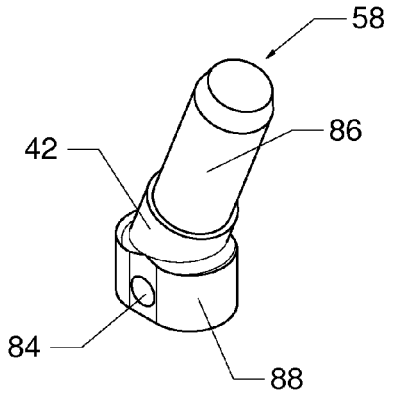
FIG. 8A is a perspective view illustrating an interchangeable hosel with a hosel shaft mounting boss in accordance with one embodiment.
Figure 8B:
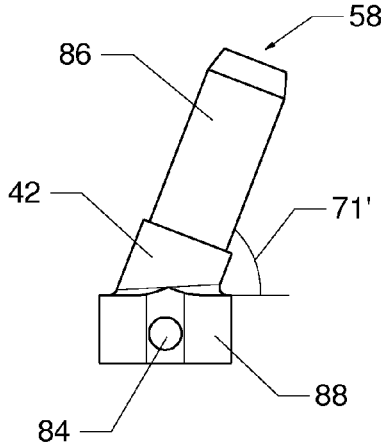
FIG. 8B is a side view illustrating an interchangeable hosel with a hosel shaft mounting boss showing a lie angle in accordance with one embodiment.
Figure 8C:
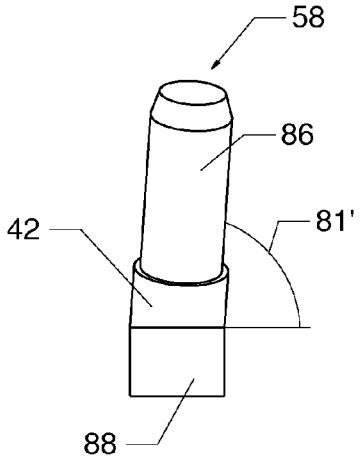
FIG. 8C is a back view illustrating an interchangeable hosel with a hosel shaft mounting boss showing a shaft loft angle in accordance with one embodiment.

One embodiment in FIGS. 8A through 8C (perspective, side, and back views) illustrates a interchangeable hosel 58. Interchangeable hosel 58 provides the connection between shaft 52 and club head 50'. Interchangeable hosel 58 provides several features allowing golfers to easily customize the parabolic golf club system. Interchangeable hosel 58 may be CNC machined, cast, extruded, or otherwise formed and shaped from polymers, aluminum, steel, stainless steel, brass, and other materials into various shapes, angles and configurations. Further, interchangeable hosel 58 may be coated with a finish to provide corrosion resistance, color, and other aesthetic and performance enhancing characteristics. Coatings may include anodize, paint, powder coat, dyes, PVD, and other plating and coating options. Additional alternative embodiments relating to interchangeable hosel 58 are discussed in more detail in the following paragraphs.

Interchangeable hosel 58 consists of a hosel body mounting boss 88. Hosel body mounting boss 88 may be an oblong boss where the major axis is greater than the minor axis (i.e. length is greater than width). Hosel body mounting boss 88 height may be between 0.250 and 0.750 inches or greater depending on specific design and overall club head 50' thickness. Hosel body mounting boss 88 is located on the base of interchangeable hosel 58 providing a means to precisely align club head 50' to interchangeable hosel 58 and grip 54 (FIG. 4A) in a right-hand and left-hand configuration. Additional hosel body mounting boss 88 shapes are permitted provided the interchangeable hosel 58 mounting configurations are right-hand (FIG. 4A) and left-hand (FIG. 4B) configurations.

A hosel fastener hole 84 passes through hosel body mounting boss 88 parallel to the center line of the minor axis. Hosel fastener hole 84 may be threaded or un-threaded and restrains interchangeable hosel 58 from removal when fastened to club head 50'. Additionally, other features may be employed to secure interchangeable hosel 58 to club head 50' in lieu of hosel fastener hole 84, for example; adhesives, solder joints, or other mechanical fastener styles.

A shaft stop ring 42 is contiguously formed to hosel body mounting boss 88. Shaft stop ring 42 provides a fixed stop location for the distal end of shaft 52. Shaft stop ring 42 diameter is approximately equal to the outer shaft 52 diameter providing a nearly seamless continuation of shaft 52 so as to not distract the golfer. Shaft stop ring 42 diameter varies between approximately 0.250 and 0.750 inches.

A hosel shaft mounting boss 86 is contiguously formed and located above shaft stop ring 42. Hosel shaft mounting boss 86 provides a means to attach shaft 52 to interchangeable hosel 58. Additionally cylindrically shaped hosel shaft mounting boss 86 provides a means to rotate the shaft and grip on interchangeable hosel 58 to correctly align the grip 54 features with club head 50' and face region 94. Hosel shaft mounting boss 86 diameter is approximately equal to or slightly less than the inner shaft 52 diameter. Hosel shaft mounting boss 86 receives the inner bore of shaft 52. Hosel shaft mounting boss 86 length may vary between approximately 0.250 and 1.250 inches with diameter varying between approximately 0.250 and 0.750 inches.

In one embodiment illustrated in FIG. 8B shaft stop ring 42 and a hosel shaft mounting boss 86 form a lie angle 71' with the top surface of hosel body mounting boss 88. Lie angle 71' is measured parallel to the major axis as illustrated in FIG. 8B and positions the golfer in the heel/toe direction parallel to face region 94 (FIGS. 4A and 4B). Lie angle 71' may be completely horizontal (90 degrees), completely vertical (0 degrees) with lie angle 71' between 10 degrees and 30 degrees from the vertical being common.

In one embodiment illustrated in FIG. 8C the shaft stop ring 42 and a hosel shaft mounting boss 86 form a shaft loft angle 81' with the top surface of the hosel body mounting boss 88 measured parallel to the minor axis. Shaft loft angle 81' positions the golfer in the forward and rearward position, with face region 94 being the forward location (FIG. 4C). Shaft loft angle 81' may be completely horizontal (90 degrees), completely vertical (0 degrees) or angled anywhere between the vertical and horizontal positions. Shaft loft angle 81' of +/−5 degrees from vertical are common.

Lie angle 71' and shaft loft angle 81' allow golfers with various heights and differing address positions to accommodate their particular golfing setup. The interchangeable hosel 58 allows golfers to make lie angle 71' and shaft loft angle 81' changes after purchasing the golf club 40'. The interchangeable hosel 58 also allows golfers to try multiple lie angles 71' and shaft loft angle 81' prior to purchasing golf club 40' and order a custom fit club for their specific golfing style. Additionally, interchangeable hosel 58 allows individual components to be replaced if damaged rather than replacing an entire golf club.

Figure 8D:
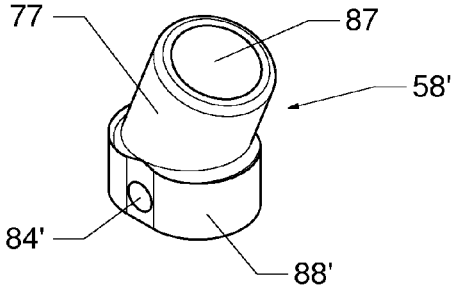
FIG. 8D is a perspective view illustrating an interchangeable hosel with a hosel shaft mounting bore in accordance with one alternative embodiment.

Another embodiment of interchangeable hosel 58' is illustrated in FIG. 8D (perspective view). Interchangeable hosel 58' consists of hosel body mounting boss 88' and hosel fastener hole 84' as previously described. A hosel shaft sleeve 77 replaces shaft stop ring 42 and a hosel shaft mounting bore 87 replaces hosel shaft mounting boss 86. Hosel shaft sleeve 77 is contiguously formed to hosel body mounting boss 88'. Hosel shaft sleeve 77 may be approximately between 0.250 and 1.250 inches long and may have a diameter approximately between 0.250 and 0.750 inches. Hosel shaft mounting bore 87 is co-axially and concentrically drilled into hosel shaft sleeve 77. Hosel shaft mounting bore 87 is substantially shallower than hosel shaft sleeve 77 length, creating a blind cavity. Hosel shaft mounting bore 87 depth may be between 0.250 and 1.250 inches and may have a diameter between 0.250 and 0.750 inches. Additionally, hosel shaft mounting bore 87 depth may not pass into hosel body mounting boss 88'. Hosel shaft mounting bore 87 provides a bore to receive the outer diameter of shaft 52. The bottom of hosel shaft mounting bore 87 provides a fixed stop location for the distal end of shaft 52.

Figure 8E:
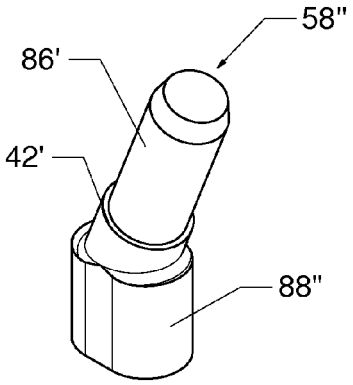
FIG. 8E is a top perspective view illustrating an interchangeable hosel with a hosel shaft mounting boss and hosel fastener hole located in the base of hosel body mounting boss in accordance with one alternative embodiment.
Figure 8F:
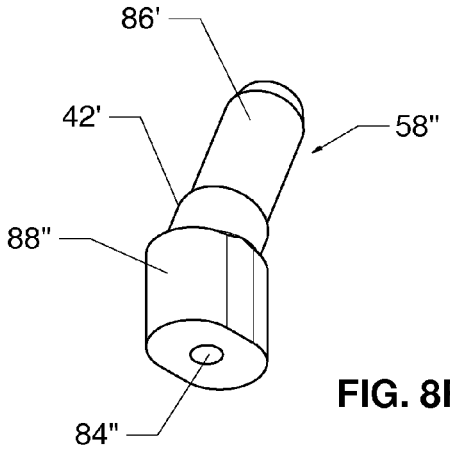
FIG. 8F is a bottom perspective view illustrating an interchangeable hosel with a hosel shaft mounting boss and hosel fastener hole located in the base of hosel body mounting boss in accordance with one alternative embodiment.

Another alternative embodiment of interchangeable hosel 58" is illustrated in FIGS. 8E and 8F. Interchangeable hosel 58" consists of hosel body mounting boss 88", shaft stop ring 42', hosel shaft mounting boss 86', and hosel fastener hole 84" as previously described. Hosel body mounting boss 88" may be taller than previous embodiments. Hosel body mounting boss 88" height may be between 0.500 and 1.250 inches or greater depending on specific design and overall club head 50' thickness. The taller hosel body mounting boss 88" provides space for a hosel fastener hole 84" drilled vertically from bottom of hosel body mounting boss 88" toward hosel shaft mounting boss 86'. Hosel fastener hole 84" may be threaded or un-threaded and restrains interchangeable hosel 58" from moving when engaged or fastened to club head 50'. Additionally, other features may be employed to secure interchangeable hosel 58" to club head 50' in lieu of hosel fastener hole 84" for example; adhesives, solder joints, and other styles of mechanical fasteners.

It can be appreciated lie angle 71' and shaft loft angle 81' may vary in the alternative embodiments (FIGS. 8D through 8F) in a similar manner as the previous embodiments illustrated in FIGS. 8A through 8C. Additionally the alternate embodiments of interchangeable hosel 58' and 58" and its alternative features may be formed using the various methods and materials previously discussed. The designs described and illustrated in this specification should not be used to limit the scope.

Operation—Embodiment 2—FIG. 9A

An exploded view of an alternative embodiment detailing a club head assembly 39 is illustrated in FIG. 9A. Club head assembly 39 is used to describe the operation. The manner of using golf club 40' (FIGS. 4A and 4B) to strike a golf ball is similar to the method discussed previously. The golfer rests sole region 91 on the ground in their setup position. The golfer grasps grip 54 utilizing their regular golf club or putting grip, depending on club head 50 type, and aligns the front sight aid 68' with the golf ball and the rear sight aid 70' along the intended travel path of the golf ball. However, there are several alternative features allowing golfers to customize club head assembly 39 to their individual style.

Hosel Configuration and Operation

The golfer first configures golf club 40' for a right hand (FIG. 4A) or left hand (FIG. 4B) golfer. The golfer changes from a right hand (FIG. 4A) configuration to a left hand (FIG. 4B) configuration by removing hosel fastener 62 from inner hosel fastener hole 80 (FIG. 6A), hosel fastener hole 84, and outer hosel fastener hole 78 (FIG. 6A). Once hosel fastener 62 is removed, interchangeable hosel 58 is removed from hosel installation pocket 72 by pulling upward on interchangeable hosel 58, separating hosel body mounting boss 88 from hosel installation pocket 72 and club head 50'.

Once separated interchangeable hosel 58 is rotated about its vertical axis (z-axis) 180 degrees and hosel body mounting boss 88 is replaced into hosel installation pocket 72. Once hosel body mounting boss 88 is fully inserted into hosel installation pocket 72 hosel fastener 62 is re-installed through outer hosel fastener hole 78 (FIG. 6A), hosel fastener hole 84 (FIG. 6A), and inner hosel fastener hole 80 (FIG. 6A). Hosel fastener 62 is tightened against the back surface of the first large counter-bored cavity portion of outer hosel fastener hole 78 (FIG. 6A). The recess provided by the counter-bore keeps hosel fastener 62 flush or slightly recessed into club head 50'. The recessed counterbore prevents the head on hosel fastener 62 from being visible to the golfer in the address position. The blind cavity created when forming hosel installation pocket 72 helps ensure interchangeable hosel 58 (FIGS. 8A through 8F) is securely mounted to club head 50' and does not move during the swing. Additionally a solid base at the bottom of hosel installation pocket 72 provides a stationary installation surface with a consistent insertion depth. This process is repeated to return to a right hand (FIG. 4A) configuration.

The inner diameter of shaft 52 may be inserted over hosel shaft mounting boss 86 until shaft 52 end contacts shaft stop ring 42. The cylindrically shaped hosel shaft mounting boss 86 provides a means to rotate the shaft and grip in interchangeable hosel 58 to correctly and precisely align the grip features with club head 50' and face region 94. Shaft 52 may be secured to hosel shaft mounting boss 86 by brazing, soldering, mechanical fasteners and common club making adhesives. Those skilled in the art recognize the various epoxies and supplies available for shaft 52 attachment.

The golfer may adjust lie angle 71' and shaft loft angle 81' (FIGS. 8A through 8F) by replacing one interchangeable hosel 58 with another interchangeable hosel 58 of a new lie angle 71' and shaft loft angle 81'. The interchangeable hosel 58 is removed and replaced following the procedure previously discussed. The golfer determines their correct lie angle 71' and shaft loft angle 81' by finding a comfortable stance some distance away from the ball and substituting one interchangeable hosel 58 for another until sole region 91 rests flat on the ground. The golfer then swings golf club 40 in a pendulum or arcing motion and strikes the ball on the forward stroke. As previously described, golf club 40 (FIGS. 4A through 4C) is designed with shaft 52 and interchangeable hosel 58 located at the parabola's focus to reduce twisting during the swing and at impact with the golf ball at any location on face region 94 or face insert 56. The ability for a golfer to modify lie angles 71' and shaft loft angle 81' helps improve accuracy, consistency, and feel for individual golfers. Various course conditions may also favor certain lie angles 71' and shaft loft angle 81' over others.

Weight Configuration & Operation

One embodiment of club head assembly 39 allows the golfer to add, remove, or interchange a plurality of weight 60 located along parabolic path 44 (FIG. 5A). Interchangeable weight 60 allows golfers of all skill levels the ability to easily alter the overall weight, MOI, CG and make club head assembly 39 face, tail, heel, toe weighted or any combination of these weighting configurations to match their feel and swing path.

Increasing overall mass and moment of inertia (MOI) helps reduce the twisting about shaft 52. A higher MOI and overall mass helps keep face region 94 square during impact with the ball. One way to increase the MOI of club head assembly 39 is by placing weight 60 at the outermost boundaries of club head 50' along parabolic path 44 (FIG. 5A). Club head 50' with a higher MOI and higher mass is more stable, less susceptible to twisting, more forgiving, and better able to resist angular acceleration when combined with the parabolic properties previously discussed. This is due to Newton's second law of motion stating if an unbalanced force acts upon club head assembly 39 the result accelerates club head assembly 39 in the direction of the applied force. Therefore, a greater force is needed to accelerate a higher MOI and heavier club head assembly 39 from the intended swing path than a lower MOI and lighter club head assembly 39.

The center of gravity (CG) may also be adjusted by adding or subtracting weight 60 from club head 50' along parabolic path 44 (FIG. 5A). If the CG is located far away from hosel installation pocket 72 and face region 94, a large force is required to accelerate club head assembly 39 from the intended swing path. If the CG is located close to hosel installation pocket 72 and face region 94, a smaller force is required to accelerate club head assembly 39 from the intended swing path. Therefore, a CG located farther from hosel installation pocket 72 and face region 94 often produces a more consistent steady swing path than if CG is close to hosel installation pocket 72 and face region 94. This is again due to Newton's second law of motion.

The golfer adjusts the club head assembly 39 mass and weighting by first inserting at least one weight 60 onto club head 50'. Weight 60 is installed by aligning weight locking boss 48 with one of the plurality of weight locking pockets 74 located on top surface 93 of club head 50'. Weight locking pocket 74 matches the shape and depth of weight locking boss 48 to provide a non-rotating connection between weight 60 and club head 50'. Weight locking boss 48 may be similar in shape and height to weight locking pockets 74 and provide a light press fit or running fit when installed in a weight locking pocket 74. Weight 60 is considered seated when weight locking boss 48 and the mating weight locking pocket 74 are aligned and weight base 51 contacts the top region 93 of club head 50'.

Once weight 60 is engaged in weight locking boss 48, a weight fastener 64 is inserted from sole region 91 of club head 50' through one of the plurality of weight fastener cavities 76 (FIG. 5C). Weight fastener 64 is rotated with an appropriate tool in weight fastener cavities 76 (FIG. 5C) while simultaneously keeping weight locking boss 48 engaged in weight locking pocket 74. Weight fastener 64 becomes engaged into weight locking hole 98 by continuing to rotate weight fastener 64 until the threads or other locking means engage in weight locking hole 98. Weight fastener 64 is rotated until the head is seated against the back surface of the first large counter-bore of weight fastener cavities 76 (FIG. 5C) and weight base 51 is tightly secured against the top surface 93 of club head 50' with weight locking boss 48 fully engaged in weight locking pocket 74. The recess provided by the counter-bore keeps weight fastener 64 flush or slightly recessed into club head 50' to prevent weight fastener 64 from contacting the ground or putting surface and adversely interfering with the swing. This process is repeated until at least one weight 60 is secured to club head 50' in the configuration selected by the user. Additional weight 60 may be added by repeating this procedure and installing weight 60 in additional unoccupied weight locking pockets 74.

Weight 60 removal is opposite of installation by first removing weight fastener 64 with an appropriate tool. After weight fastener 64 is completely removed from weight 60 and weight fastener hole 76 (FIG. 5C), weight 60 is grasped and pulled upward to disengage weight locking boss 48 from weight locking pockets 74. Once removed the same sized weight 60 or a plurality of differently sized weight 60 are placed in weight locking pockets 74.

Arranging weight 60 in various locations along parabolic path 44 allows club head assembly 39 to be toe weighted, heel weighted, face weighted, tail weighted or any combination of these weighting configurations. In addition to the parabolic properties, positioning weight 60 in locations along parabolic path 44 to move the CG in various directions away from focus 47 may cause club face region 94 pivot differently about focus 47 (FIG. 2A) and shaft 52. Positioning weight 60 along parabolic path 44 (FIG. 2A) alters the CG changing the swing trajectory of club head 50' in several ways. The change in CG may help a golfer correct an open or closed club face condition and improve the straightness of a particular golf shot or putt.

If toe region 92 side contains more weight 60, club head assembly 39 is generally referred to as being toe weighted. A club head 50' is made toe weighted by moving the center of gravity (CG) toward toe region 92. A body, in this case club head 50', generally rotates about its CG. Placing the CG on the toe region 92 side of hosel installation pocket 72 may cause the heel region 90 to contact the golf ball before the toe region 92. The resulting action on the golf ball tends to be a "pushed" shot for a right hand golf club 40' configuration (FIG. 4A).

If heel region 90 side contains more weight 60, club head assembly 39 is generally referred to as being heel weighted. Club head 50' is made heel weighted by moving the center of gravity (CG) toward heel region 90. A body, in this case club head 50', generally rotates about its CG. Placing the CG on the heel region 90 side of hosel installation pocket 72 generally causes the toe region 92 to contact the golf ball before the heel region 90. The resulting action on the golf ball tends to be a "pulled" shot for a right hand golf club 40' configuration (FIG. 4A).

The club is face weighted if weight 60 are placed in front of hosel installation pocket 72 toward face region 94 and distributed equally between heel region 90 and toe region 92. The CG is located along the axis of symmetry 43 between the face region 94 and tail region 96. This CG location stabilizes club head 50 between the heel region 90 and toe region 92 creating a neutral face position where heel region 90 and toe region 92 are parallel to Y-axis 41 (FIG. 2A). The neutral face position keeps the face in a substantially square position at impact where the heel region 90 and toe region 92 impact the golf ball simultaneously resulting in a straight shot for a right hand golf club 40' configuration (FIG. 4A). Additionally, the face weighted club may result in a downward impact to the golf ball if the CG is ahead of hosel installation pocket 72. The downward impact may cause the golf ball "jump" when contacted due to backspin. The jump may help the golfer play the ball over a fringe or other obstacle between the golf ball and the hole.

The club is tail weighted if weight 60 are placed behind hosel installation pocket 72 toward tail region 96 and distributed equally between heel region 90 and toe region 92. The CG is located along the axis of symmetry 43 between the face region 94 and tail region 96. This CG location stabilizes club head 50 between the heel region 90 and toe region 92 creating a neutral face position where heel region 90 and toe region 92 are parallel to Y-axis 41 (FIG. 2A). The neutral face position keeps the face in a substantially square position at impact where the heel region 90 and toe region 92 impact the golf ball simultaneously resulting in a straight shot for a right hand golf club 40' configuration (FIG. 4A). Additionally the tail weighted configuration may result in an upward impact to the golf ball if the CG is behind hosel installation pocket 72. The upward impact may produce top spin on the golf ball causing the ball to "roll" when contacted. The topspin may help initiate a smoother roll and travel more consistently along the intended target line.

Weight 60 can be positioned in any combination of the locations described above to fully customize overall weight and swing path of golf club 40 (FIGS. 4A through 4C) for the individual golfer. When weight 60 configurations are combined, for example a heel and tail weight 60 combination, golf club 40 (FIGS. 4A through 4C) overall weight and performance characteristics are being fine tuned by the golfer to improve their putting accuracy and consistency.

It can be appreciated there are nearly infinite mass and weight 60 configuration options for club head assembly 39 along parabolic path 44. A variety of adjustment options for increasing overall mass, MOI, and moving CG away from hosel installation pocket 72 and face region 94 are available to golfers with the parabolic golf club system. Installing weight 60 along parabolic path 44 (FIG. 5A) helps keep club head assembly 39 traveling along the intended swing path and keeps face region 94 square on off-center hits. Golfers may select from a plurality of weight 60 shapes, sizes and materials to customize the weighting and decide not to install any weight 60 on club head 50'. The basic configurations are presented here to exemplify the nearly infinite variety of possible configurations. Golfers start with a stable club head 50' platform utilizing parabolic properties previously discussed and customize the MOI, CG, and overall mass to suit their playing style and improve swing accuracy and consistency.

Face Configuration & Operation

One embodiment of club head assembly 39 allows golfers to select from a plurality of face insert 56 options. Face region 94 is the initial impact location for striking the golf ball and is located at directrix 45 of a parabolic path 44 (FIG. 2A) as previously described. In an alternative embodiment face region 94 may be configured and operate similar to the embodiment described and illustrated in FIGS. 1A through 3F.

In an alternative embodiment face insert cavity 66 is machined into face region 94 allowing golfers to select from a variety of face insert 56 materials, features, patterns, shapes and other options. Additionally, face insert 56 may not be permanently affixed to club head 50' and may be removed and replaced with another face insert 56. The new face insert 56 may be a different material, contain a new feature or pattern on the planar striking surface 61, and may contain a variety or combination of any feature, pattern or material. Examples of face insert 56 patterns were presented earlier in this description and are illustrated in FIGS. 6B and 6D.

The removal and installation process for face insert 56 is dependent on the material, features, patterns and specific design. Face inset 56 may be attached by adhesive, chemical bond, mechanical fasteners such as screws and camlocks, welding, fusing or brazing. In one embodiment face insert 56 may be attached by an adhesive. Adhesive is applied to the back of face insert 56. Face insert 56 is pressed into face insert cavity 66 with planar striking face 61 flush with the surrounding face region 94, providing a nearly seamless fit when inserted into face insert cavity 66. Face insert 56 is clamped in place until the adhesive cures. Face insert 56 may be removed by breaking the adhesive bond with chemicals, mechanical scraping, sanding, or other means. Once the previous face insert 56 is removed a new face insert 56 may be installed by following the same process previously described.

Alternative Embodiments—10A Through 10C

Figures 10A, 10B, 10C:
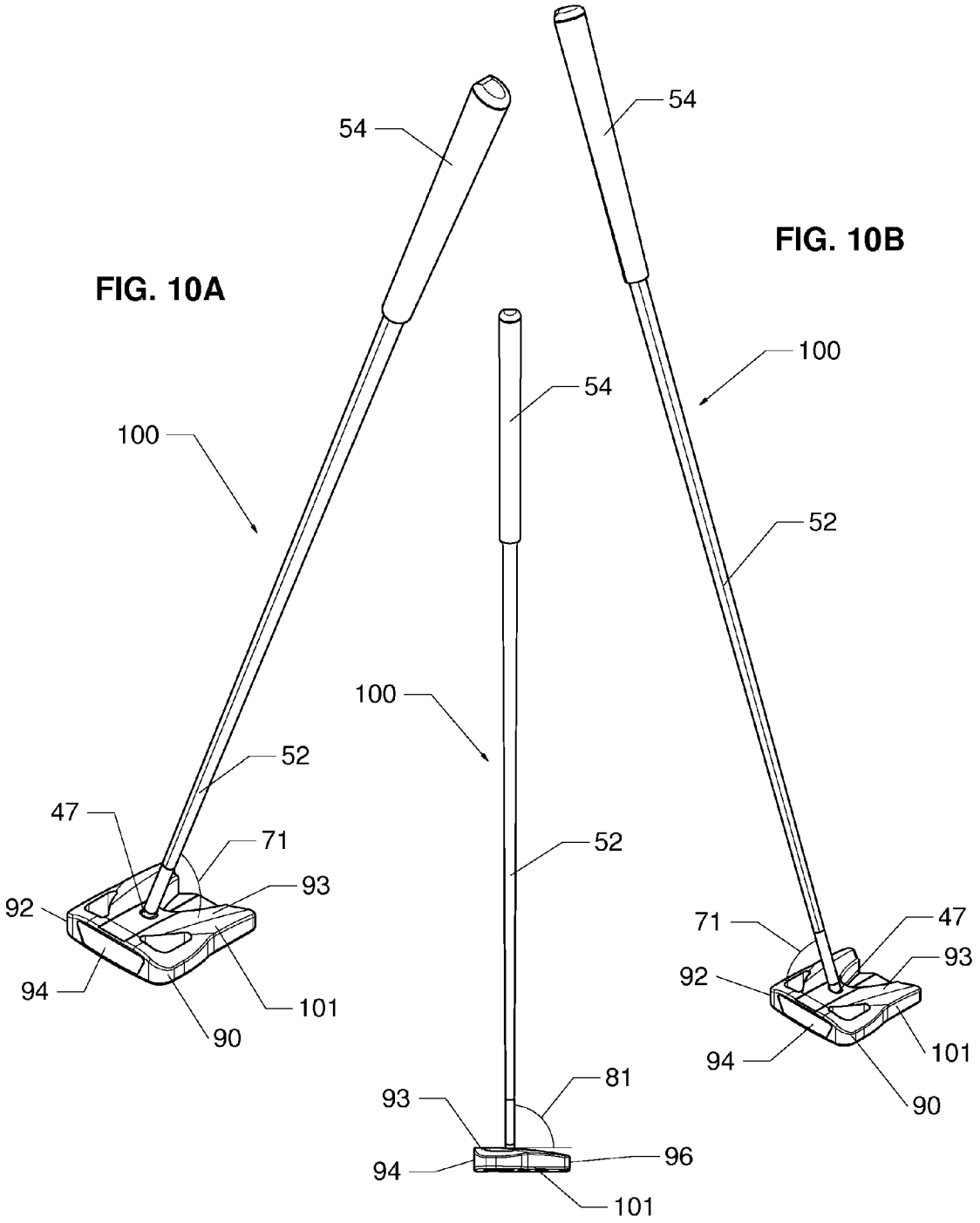
FIG. 10A is a perspective view illustrating a golf club in a right hand configuration with concealed weight features and weights disposed along a parabolic path in accordance with one alternative embodiment.
FIG. 10B is a perspective view illustrating a golf club in a left hand configuration with concealed weight features and weights disposed along a parabolic path in accordance with one alternative embodiment.
FIG. 10C is a back view illustrating a golf club and a shaft loft angle with concealed weight features and weights disposed along a parabolic path in accordance with one alternative embodiment.

One alternative embodiment of a golf club assembly 100 consists of an alternative club head 101 shape illustrated in FIGS. 10A through 10C (perspective views and side view). In one alternative embodiment golf club assembly 100 consists of a club head 101 in a substantially block shaped configuration. Golf club assembly 100 consists of the components described earlier such as grip 54, shaft 52, face region 94 located at directrix 45 (FIG. 2A), and shaft 52 attached to club head 101 by a hosel 59 (FIG. 3D) or a interchangeable hosel 58 (FIGS. 8A through 8F) located at focus 47.

Golf club assembly 100 is illustrated in a right-hand configuration in FIG. 10A and a left-hand configuration is illustrated in FIG. 10B. Shaft 52 may form a lie angle 71 between a horizontal plane defined by top region 93. Lie angle 71 is measured substantially parallel to face region 94 with shaft 52 angled toward heel region 90 or toe region 92 at various angles. Additionally, shaft 52 may form a shaft loft angle 81 (FIG. 10C) between a horizontal plane defined by top region 93. Shaft loft angle 81 is measured substantially perpendicular to face region 94 with shaft 52 angled toward tail region 96 or face region 94.

Club head 101 also utilizes the reflective properties of a parabola by attaching shaft 52 at a focus 47 (FIG. 2A) and positioning face region 94 at directrix 45 (FIG. 2A) of parabolic path 44 (FIG. 2A). Focus 47, directrix 45, parabolic path 44 and other parabolic features were previously illustrated in FIG. 2A and discussed in detail in a previous section of this specification. A description detailing alternative club head 101 features is found in the following paragraphs.

Alternative Club Head—FIGS. 11A Through 11D

Four perspective views showing club head 101 and several features are illustrated in FIGS. 11A through 11D for an alternative embodiment. Club head 101 is constructed using the methods and materials described in previous embodiments. The substantially block-shaped club head 101 provides a smooth appearance for the golfer when viewed from the top.

Figure 11A:
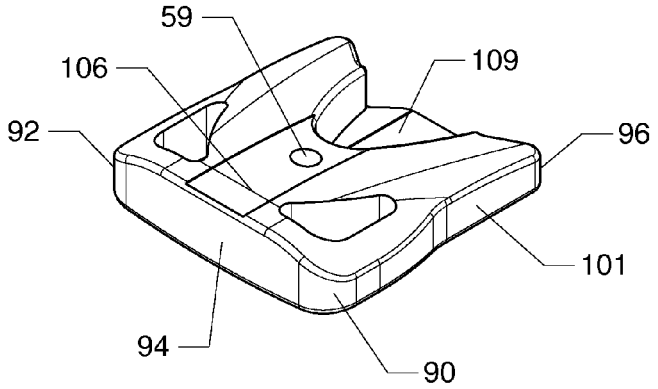
FIG. 11A is a top front perspective view illustrating a block shaped club head with face located at a directrix and shaft located at a focus of a parabolic path in accordance with one alternative embodiment.

A top perspective view of club head 101 in FIG. 11A illustrates how the overall club head 101 shape differs from previous embodiments described. In addition to the substantially block-shaped club head 101, the height remains more consistent from face region 94 to tail region 96 without a significant height transition immediately behind face region 94. The consistent height with smooth transitions may appeal to certain golfers while other golfers may like the sharper, distinctive lines of previous embodiments.

One alternative embodiment of club head 101 illustrated in FIG. 11A consists of a face region 94 contiguously formed into club head 101 using similar materials, loft angles 75 (FIGS. 3B and 3C), material hardness, shapes and features as described for previous embodiments. Additionally, face region 94 may have a smooth contact surface 82 (FIG. 3A), swirl groove pattern 82' (FIG. 3D), horizontal groove pattern 82" (FIG. 3E) and other patterns as described and illustrated in previous embodiments.

Hosel 59 may also be bored directly into club head 101 at a lie angle 71 (FIGS. 11A and 11B) allowing shaft 52 to attach directly to club head 101 as described in previous embodiments and illustrated in FIG. 3A. Additionally, club head 101 may also consist of hosel installation pocket 72' illustrated in FIGS. 11B and 11C. Hosel installation pocket 72' is bored from top region 93 vertically down toward sole region 91. Hosel installation pocket 72' may be approximately 0.500 to 1.000 inches deep creating a blind pocket that does not exit through sole region 91. Hosel 59 and hosel installation pocket 72' are similar to the features described and illustrated in previous embodiments.

Figure 11B:
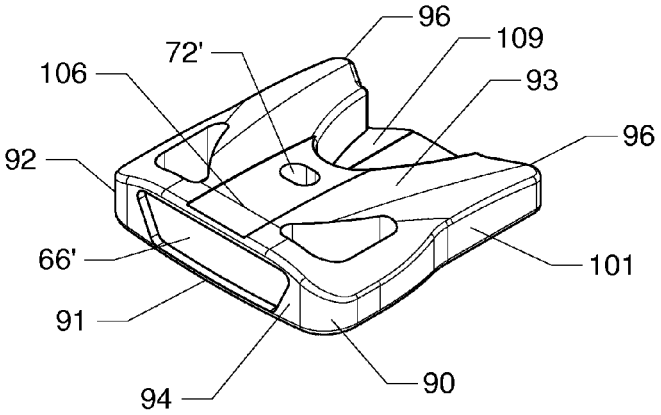
FIG. 11B is a top front perspective view illustrating a block shaped club head with face insert cavity located at a directrix and hosel installation pocket located at a focus of a parabolic path in accordance with one alternative embodiment.
Figure 11C:
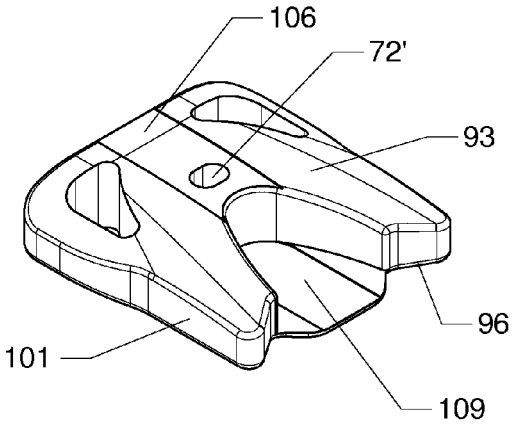
FIG. 11C is a top back perspective view illustrating a block shaped club head with a tail pocket and hosel installation pocket located at a focus of a parabolic path in accordance with one alternative embodiment.

A tail pocket 109, located in the tail region 96, with vertical walls following an interior, substantially parabolic path 44 (FIG. 2A) is illustrated in FIGS. 11A through 11C. Tail pocket 109 is located near tail region 96 and removes mass from the center of club head 101 and concentrates the mass toward the heel region 90 and toe region 92 to improve MOI characteristics. Tail pocket 109 also allows mass removed from the center of club head 101 to be concentrated along the parabolic arc 44 (FIG. 2A). Additionally, tail pocket 109 provides a means for golfers to pick up a golf ball by scooping it off the ground.

The consistent height also provides for a larger area to display alternative sight aids 106. One alternative sight aid 106 shown in FIGS. 11A through 11C consists of a long band approximately the width of a golf ball providing a substantial visual cue to square face region 94 and center the golf ball between heel region 90 and toe region 92. Alternative sight aid 106 is similar to previous sight aid descriptions and illustrations. Sight aid descriptions for previous embodiments may be reviewed for sizes, colors, depths, shapes, manufacturing techniques and implementation and use methods.

Figure 11D:
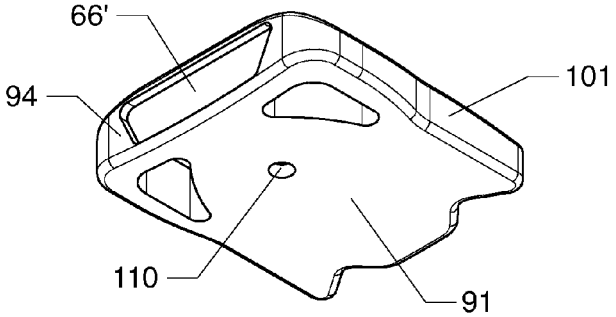
FIG. 11D is a bottom front perspective view illustrating a block shaped club head with face insert cavity located at a directrix and alternative hosel fastener hole located at a focus of a parabolic path in accordance with one alternative embodiment.

One alternative embodiment of club head 101 illustrated in FIGS. 11B through 11D consists of a face insert cavity 66' formed into face region 94. Materials, loft angles 75 (FIGS. 3B and 3C), shapes, features, depths, sizes and machining and manufacturing techniques similar to those described and illustrated in FIGS. 6B through 6D for previous embodiments may be used for face insert cavity 66'.

A bottom front view in FIG. 11D illustrates a alternative hosel fastener hole 110 located at focus 47 (FIG. 2A) disposed in club head 101. Alternative hosel fastener hole is bored from sole region 91 vertically upward through the center of hosel installation pocket 72' (FIGS. 11B and 11C). Alternative hosel fastener hole 110 provides a recessed counter-bore, countersink or otherwise relieved cavity. Alternative hosel fastener hole 110 is bored from sole region 91 along a vertical axis through top region 93 of club head 101'. Alternative hosel fastener hole 110 consists of a primary bore and a secondary bore. The primary bore is approximately equal in diameter and depth to a fastener head and provides a recess to conceal fastener head. The primary bore extends partially into sole region 91 of club head 50' and does not penetrate hosel installation pocket 72'. The secondary bore is approximately equal in diameter to the fastener body. The secondary bore, located co-axially and concentrically to the primary bore, starts at sole region 91 and exits into hosel installation pocket 72'. The head of the fastener seats against the back surface of the first large counter-bored cavity portion. The recess provided by the counter-bore keeps the fastener head flush or slightly recessed into sole region 91 of club head 101' to prevent the fastener head from contacting the ground or putting surface and adversely interfering with the swing.

Alternative Embodiment Club Head—FIGS. 12A Through 12D

One alternative embodiment of club head 101' illustrated in FIGS. 12A and 12B incorporates the features of previous embodiments with the addition of a plurality of weight pockets 102 located in sole region 91 of club head 101 and disposed along a parabolic path 44 (FIG. 2A). Weight pockets 102 concealed in sole region 91 are not visible to the golfer in the normal address position. Weight pockets 102 may be a cylindrical bore as illustrated or consist of other geometric shapes such as a rhomboid, rectangle, square, circle, triangle, parallelogram or any combination of geometric shapes. The plurality of weight pockets 102 may be approximately between 0.100 and 1.000 inches in depth and shallower than the overall club head 101' depth creating a blind cavity. Additionally, weight pockets 102 must be deep enough for alternative weight 104 (FIGS. 13A through 13C) to be flush or slightly recessed in sole region 91. The depth prevents alternative weight 104 (FIGS. 13A through 13C) from contacting the ground or putting surface and adversely interfering with the swing.

Figure 13A:
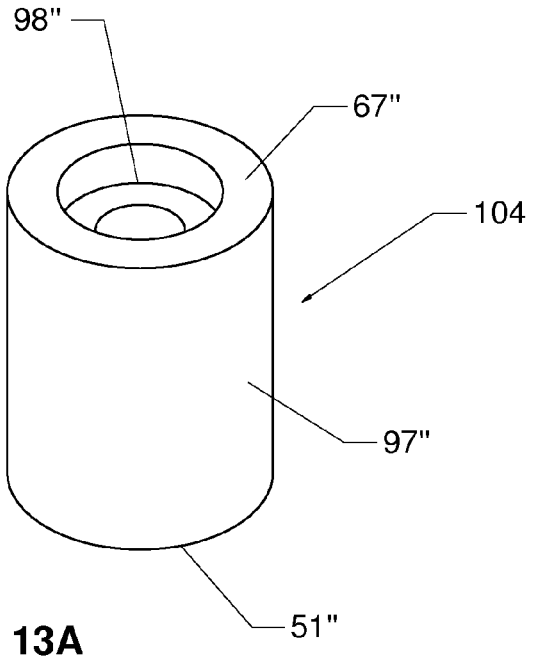
FIG. 13A is a top perspective view illustrating a weight and attachment features in accordance with one alternative embodiment.
Figure 13B:
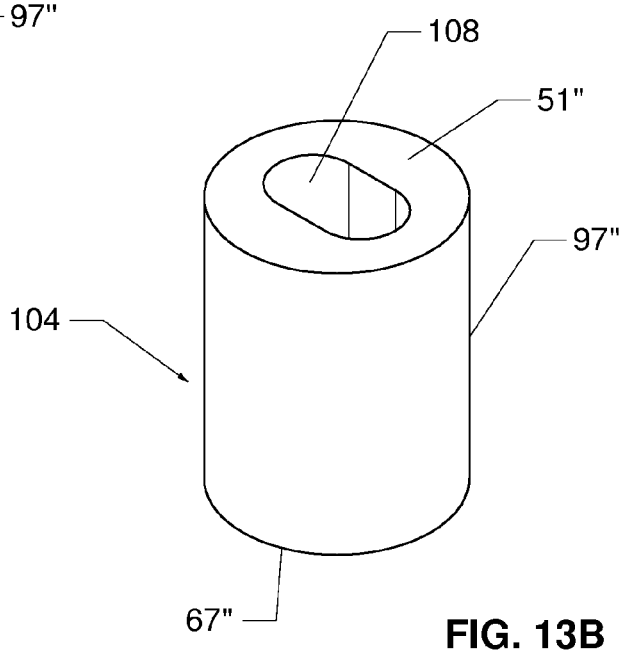
FIG. 13B is a bottom perspective view illustrating a weight and attachment features in accordance with one alternative embodiment.
Figure 13C:
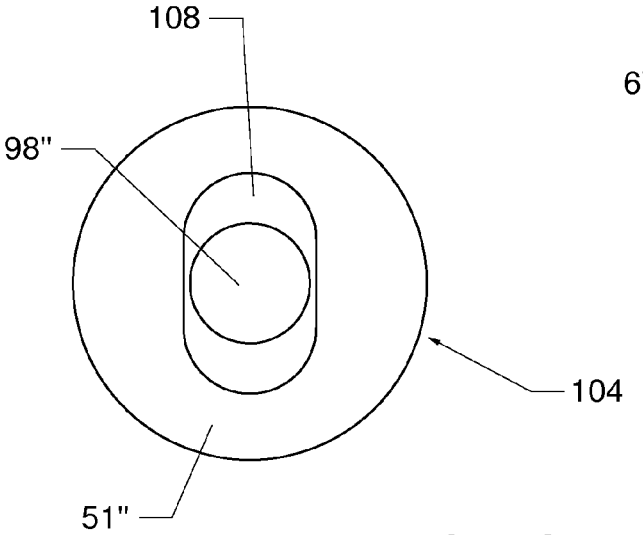
FIG. 13C is a bottom view illustrating a weight and attachment features in accordance with one alternative embodiment.

A weight locking boss 105 is located internally at the base of weight pocket 102. Weight locking boss 105 may be oblong and has a major axis that is greater than the minor axis (i.e. length is greater than width). Weight locking boss 105 is machined or formed to a precise size and shape utilizing CNC milling, casting, extrusions, and other forming and shaping methods. Weight locking boss 105 may be approximately between 0.250 and 0.500 inches in height. Weight locking boss 105 may be spaced from the vertical sides of the cylindrical weight pockets 102 allowing clearance for a alternative weight body 97" (FIGS. 13A through 13C).

Weight pocket 102 and weight locking boss 105 may consist of additional shapes or features other than the cylindrical and oblong shapes described above to securely hold alternative weight 104 (FIGS. 13A through 13C) in a stationary position during assembly. Shapes such as triangles, squares, star-shapes, etc. may be utilized to secure and position alternative weight 104 (FIGS. 13A through 13C) in a non-rotating fashion.

A plurality of weight fastener receiving bores 107 are best illustrated by the bottom view in FIG. 12B. Weight fastener receiving bores 107 are drilled into the center of each weight locking boss 105 along a vertical axis. Weight fastener receiving bores 107 are blind holes and do not pass through the top region 93 (FIG. 12A) of the club head 101'. Weight fastener receiving bores 107 may consist of a threaded or plain hole approximately between 0.250 and 0.500 inches in depth. Weight fastener receiving bores 107 may be threaded or provided with other means to receive a fastener to secure alternative weight 104 (FIGS. 13A through 13C) to club head 101'.

Alternative Embodiments—12C and 12D

A perspective view and bottom view of an alternative embodiment of a club head 101" are illustrated in FIGS. 12C and 12D respectively. In one alternative embodiment, club head 101" consists of a singular parabolic weight receiving bore 118 concealed in sole region 91 in place of the plurality of weight pockets 102 (FIGS. 12A and 12B). In the alternate embodiment club head 101" consists of similar features and construction methods and materials previously described.

Parabolic weight receiving bore 118 may be approximately between 0.100 and 1.000 inches in depth and shallower than the overall club head 101" depth creating a blind cavity. Additionally, parabolic weight receiving bore 118 must be deep enough for alternative parabolic weight 116 (FIGS. 14A through 14D) and parabolic weight cartridge 121 (FIGS. 15A through 15E) to be flush or slightly recessed into sole region 91. The depth prevents alternative parabolic weight 116 (FIGS. 14A through 14D) and parabolic weight cartridge 121 (FIGS. 15A through 15E) from contacting the ground or putting surface and adversely interfering with the swing.

Parabolic weight receiving bore 118 contains one or more weight attachment bosses 114 located internally and at the base of parabolic weight receiving bore 118 and illustrated in FIG. 13D. Weight attachment bosses 114 extend axially from the base of weight receiving bore 118 near top region 93 toward sole region 91. Weight attachment bosses 114 may be approximately one-half the overall depth of parabolic weight receiving bore 118. A solid base at the bottom of parabolic weight receiving bore 118 provides a stationary installation surface for a consistent insertion depth for alternative parabolic weight 116 (FIGS. 14A through 14D) and parabolic weight cartridge 121 (FIGS. 15A through 15E).

Weight attachment bosses 114 may be cylindrical or consist of other geometric shapes. Additional geometric shapes such as rectangles, triangles, polygons, squares, etc. may be used as weight attachment bosses 114. Weight attachment bosses 114 are machined or formed to a precise size and shape. Weight attachment bosses 114 may be approximately between 0.250 and 0.500 inches in height. Weight attachment bosses 114 may be spaced from the vertical sides of parabolic weight receiving bore 118 allowing clearance for alternative parabolic weight 116 (FIGS. 14A through 14D) and parabolic weight cartridge 121 (FIGS. 15A through 15E). In one alternative embodiment parabolic weight receiving bore 118, weight attachment bosses 114, and a weight fastener receiving bore 107' are CNC milled, cast, extruded, or otherwise formed or shaped into a nearly infinite number of shapes or configurations in club head 101".

Weight fastener receiving bore 107' is drilled axially through the center of each weight attachment boss 114. Weight fastener receiving bore 107' may consist of a threaded or plain hole approximately between 0.250 and 0.500 inches in depth. Weight fastener receiving bore 107' are blind holes and do not pass through top region 93 of the club head 101". Weight fastener receiving bores 107' may be threaded or provided with other means to receive a fastener to secure alternative parabolic weight 116 (FIGS. 14A through 14D) and parabolic weight cartridge 121 (FIGS. 15A through 15E) to club head 101".

Alternative Weight—FIGS. 13A Through 13C

Alternative weight 104 is illustrated in FIGS. 13A and 13C in perspective views and a bottom view, respectively. Alternative Weight 104 is shown as a cylinder but may consist of any geometric shape such as rectangular, triangular, polygon prisms, pyramids, cones or spheres, or other three dimensional geometric solids. Alternative weight 104 is constructed using the methods dimensions, shapes, sizes and materials previously illustrated in FIGS. 7A through 7D and described for weight 60 and 60'. The addition or subtraction of one or more alternative weight 104 alter club head 101' properties such as overall mass, MOI, CG and other similar properties as described previously.

In one alternative embodiment alternative weight 104 consists of a cylindrical portion or weight body 97" with a weight base 51" opposite weight top 67". Overall weight body 97" length may be approximately between 0.100 and 1.000 inches. Overall weight body 97" length may not exceed overall height of club head 101'. Weight base 51" and weight top 67" form the ends of weight body 97".

Weight locking pocket 108 illustrated in FIGS. 13B and 13C is oblong in shape to prevent alternative weight 104 from rotating during installation. Weight locking pocket 108 depth may be approximately between 0.250 and 0.750 inches in depth. Weight locking pocket 108 depth may be equal to or slightly deeper than weight locking boss 105 (FIG. 12B) height allowing alternative weight 104 to completely seat into weight pockets 102 (FIGS. 12A and 12B). Weight locking pocket 108 may be the same shape and height as weight locking boss 105 (FIGS. 12C and 12B) and provide a light press fit or running fit when installed over a weight locking boss 105 (FIG. 12B). It is understood weight body 97" and weight locking pocket 108 may constitute any shape such as rectangles, trapezoids, star-shapes or other geometric shapes as long as the shape doesn't allow alternative weight 104 to rotate when weight locking pocket 108 is engaged over weight locking boss 105 (FIG. 12B).

A weight locking hole 98" illustrated in FIG. 13A, is bored axially from weight top 67" through weight locking pocket 108 toward weight base 51". Weight locking hole 98" consists of a primary bore and a secondary bore. The primary bore is approximately equal in diameter and depth to a fastener head and provides a recess to conceal fastener head. The primary bore extends partially into weight top 67" approximately between 0.050 and 0.500 inches. The secondary bore is approximately equal in diameter to the fastener body. The secondary bore, located co-axially and concentric to the primary bore passes axially through weight body 97" from weight top 67" through weight base 51". The secondary bore allows the threaded portion or fastener body of weight fastener 64' (FIGS. 16A and 16B) to extend through weight body 97" allowing fastener head to seat against the back surface of primary bore. Alternative means to receive a fastener or fastening means to affix alternative parabolic weight 116 to club head 101" may be provided.

Alternative Weight Embodiments—14A and 14B

An alternative embodiment of alternative parabolic weight 116 is illustrated in FIGS. 14A and 14B (perspective views). Alternative parabolic weight 116 consists of an inner parabolic arc 115, outer parabolic arc 117, parabolic weight top 111 and parabolic weight base 113, forming a three-dimensional alternative parabolic weight 116. Alternative parabolic weight 116 may be made from any material such as metals, polymers, stainless steel, brass, copper, acetyl copolymer (Delrin®), composites, tungsten, or materials with various coatings. A number of fabrication processes may be used to form the materials including CNC machining, casting, extrusions, sintering and other forming and shaping processes through additive and subtractive methods.

The mass of alternative parabolic weight 116 illustrated in FIGS. 14A and 14B varies with overall dimensions, materials, and volume. The mass of a single alternative parabolic weight 116 may vary between a few grams or exceed several hundred grams. The distance or height between parabolic weight top 111 and parabolic weight base 113 may approximately be between 0.250 and 1.000 inches. The height between parabolic weight top 111 and parabolic weight base 113 may not exceed the overall height of club head 101" or the depth of parabolic weight receiving bore 118 (FIGS. 12C and 12D).

Alternative parabolic weight 116 consists of one or more alternative weight fastener cavities 112 to secure alternative parabolic weight 116 to club head 101". Alternative weight fastener cavities 112 are bored from parabolic weight base 113 through parabolic weight top 111. Alternative weight fastener cavities 112 consists of a primary bore and a secondary bore. The primary bore is approximately equal in diameter and depth to a fastener head and provides a recess to conceal fastener head. The primary bore extends partially into parabolic weight base 113 approximately between 0.050 and 0.500 inches. The secondary bore is approximately equal in diameter to the fastener body. The secondary bore, located co-axially and concentric to the primary bore passes axially through alternative parabolic weight 116 from parabolic weight base 113 through parabolic weight top 111. The secondary bore allows the threaded portion or fastener body of weight fastener 64" (FIGS. 17A and 17B) to extend through alternative parabolic weight 116 allowing fastener head to seat against the back surface of primary bore. Alternative weight fastener cavities 112 may be provided with other means to receive a fastener or fastening means to affix alternative parabolic weight 116 to club head 101".

Parabolic weight top 111 illustrated in FIG. 14B contains one or more parabolic weight alignment bores 120. Parabolic weight alignment bores 120 are co-axially and concentrically located with respect to alternative weight fastener hole 112 and bored from parabolic weight top 111. Parabolic weight alignment bores 120 may be approximately between 0.250 and 0.500 inches in depth. Parabolic weight alignment bores 120 may be equal to or slightly deeper than weight locking boss 105 but do not exit through parabolic weight base 113. Additionally parabolic weight alignment bores 120 are bored to a diameter equal to or slightly larger than the diameter of weight locking boss 105 (FIGS. 12C through 12D) to provide a light press or running fit between parabolic weight alignment bore 120 and weight locking boss 105.

Alternative Weight Embodiment FIGS. 14C and 14D

An alternative embodiment replaces alternative parabolic weight 116 with a plurality of parabolic mass insert plates 124 illustrated in FIGS. 14C and 14D (perspective views). Parabolic mass insert plates 124 consist of an inner parabolic arc 115' and outer parabolic arc 117' to form three-dimensional parabolic mass insert plates 124. Parabolic mass insert plates 124 are similar to alternative parabolic weight 116 (FIGS. 14A and 14B) in shape, fabrication methods, materials, and operation. Parabolic mass insert plates 124 are made thinner than alternative parabolic weight 116 allowing golfers to stack several parabolic mass insert plates 124 together to adjust overall mass, MOI, or CG in smaller increments. Parabolic mass insert plates 124 may vary in thickness from approximately 0.050 to 0.250 inches. Heavier parabolic mass insert plates 124 may be arranged closer to sole region 91 (FIGS. 14C and 14D) to move the MOI and CG of club head 101" lower. Conversely, heavier parabolic mass insert plates 124 may be arranged closer to top region 93 to move the MOI and CG of club head 101" higher. Location of MOI and CG between sole region 91 and top region 93 depend on the individual golfer.

One or more parabolic weight alignment bore 120' holes illustrated in FIG. 14D are drilled vertically from parabolic weight top 111' through parabolic weight base 113' of each parabolic mass insert plate 124. Parabolic weight alignment bore 120' holes are drilled at the same location for each parabolic mass insert plate 124 allowing multiple parabolic mass insert plates 124 to stack together and align with weight attachment boss 114 and weight fastener receiving bore 107'. Parabolic weight alignment bore 120' operates and functions similarly to parabolic weight alignment bores 120 described in previous embodiments.

A parabolic mass base plate 119 illustrated in FIG. 14D may consist of a plurality of alternative weight fastener cavities 112' that align with parabolic weight alignment bore 120'. Weight fastener cavities 112' are countersunk or counter-bored on one side similar to the counter-bore or countersink described for alternative parabolic weight 116. Parabolic mass base plate 119 contains one or more alternative weight fastener cavities 112'. Alternative weight fastener cavities 112' consist of a parabolic weight alignment bore 120' drilled concentrically from parabolic weight top 111' through parabolic mass base plate 119. Parabolic weight alignment bore 120' and alternative weight fastener cavities 112' operate and function similarly to parabolic weight alignment bores 120 and alternative weight fastener cavities 112 described in previous embodiments. Additionally parabolic weight alignment bores 120' are bored to a diameter equal to or slightly larger than the diameter of weight fastener receiving bore 107' (FIG. 12D) to provide clearance for a fastener to attach parabolic mass insert plates 124 and parabolic mass base plate 119 to club head 101" (FIGS. 12C and 12D).

Alternative Weight Embodiments—15A Through 15E

An alternative embodiment of a parabolic weight cartridge 121 illustrated in FIGS. 15A and 15B (perspective views). Parabolic weight cartridge 121 consists of a plurality of parabolic mass insert bores 122 bored along a parabolic path 44 (FIG. 2A) located equidistant between inner parabolic arc 115" and outer parabolic arc 117". Parabolic weight cartridge 121 uses materials and fabrication methods similar to mass embodiments previously discussed.

Parabolic weight base 113" contains one or more alternative weight fastener hole 112". Alternative weight fastener hole 112" are similar to alternative weight fastener cavities 112 and 112' discussed previously and illustrated in FIGS. 14A and 14D. The appropriate parabolic mass insert bores 122 illustrated in FIG. 15B are co-axially and concentrically located with respect to the alternative weight fastener hole 112". and bored starting from parabolic weight top 111". Parabolic mass insert bores 122 are drilled to a predetermined depth but not completely through parabolic weight base 113" or the counter-bored alternative weight fastener hole 112". Parabolic mass insert bores 122 may be approximately between 0.100 and 0.750 inches in depth. Additionally parabolic mass insert bores 122 are bored to a diameter equal to or slightly larger than the diameter of alignment bore weight 126 and solid weight 128 (FIGS. 15C through 15E) to provide a light press or running fit when inserted into the parabolic mass insert bores 122. Parabolic mass insert bores 122 may be approximately between 0.100 and 0.750 inches in diameter.

A plurality of solid weight 128 and alignment bore weight 126 illustrated in FIGS. 15C through 15E may be disposed in the plurality of parabolic mass insert bores 122 (FIG. 15B). Solid weight 128 (perspective view) is illustrated in FIG. 15C and alignment bore weight 126 is illustrated in FIGS. 15D and 15E (perspective view and bottom view, respectively). In one embodiment, solid weight 128 and alignment bore weight 126 are cylinders but may consist of any geometric shape, material, or other features discussed in previous embodiments. Additionally, fabrication process, materials, coatings, operation and configurations are similar to those discussed in previous mass embodiments.

In one embodiment illustrated in FIG. 15C, solid weight 128 consists of a cylindrical portion or weight body 97'" with a weight base 51'" opposite weight top 67'". Mass of solid weight 128 varies with overall dimensions. The mass of a single solid weight 128 may vary between a few grams or exceed several hundred grams. Overall solid weight 128 dimensions vary widely and are dependent on the shape, material, volume and overall mass. A cylindrically shaped solid weight 128 may consist of a length and diameter approximately between 0.100 and 0.750 inches. Additionally, solid weight 128 may be designed to fit into one or more of a plurality of parabolic mass insert bores 122 without alternative weight fastener hole 112" (FIG. 15B).

In an alternative embodiment illustrated in FIGS. 15D and 15E, alignment bore weight 126 consists of a cylindrical weight body 97"" and a through hole, referred to as a weight locking hole 98'", bored axially from weight base 51"" to a depth equal to weight attachment boss 114 height (FIGS. 12C and 12D). Weight locking hole 98'" provides a means for a fastener body to pass through alignment bore weight 126 and engage weight fastener receiving bore 107'. Alignment bore weight 126 is intended to be installed at locations in parabolic weight cartridge 121 where alternative weight fastener cavities 112" are located (FIG. 15A).

Alignment bore weight 126 contains a internal weight alignment bore 130 illustrated in FIG. 15E. Internal weight alignment bore 130 is drilled co-axially and concentrically to weight locking hole 98'" starting from weight base 51"" and traveling axially toward weight top 67"" (FIG. 15D). Internal weight alignment bore 130 is drilled to a depth equal to or slightly greater than weight attachment boss 114 (FIGS. 12C and 12D) height. Internal weight alignment bore 130 depth may be approximately between 0.250 and 0.500 inches. Additionally, internal weight alignment bore 130 may be approximately between 0.100 and 0.500 inches in diameter. Internal weight alignment bore 130 is approximately equal in diameter to weight attachment boss 114 (FIGS. 12C and 12D) diameter. Internal weight alignment bore 130 is intended to provide clearance for weight fastener 64" when securing parabolic weight cartridge 121 (FIG. 15A) to club head assembly 103" (FIGS. 18A and 18B).

Alternative Embodiment Operation—FIGS. 16A Through 16C

An exploded view of an alternative embodiment detailing a club head assembly 103 illustrated in FIGS. 16A through 16C and is used to describe the operation. The manner of using golf club assembly 100 (FIGS. 10A through 10C) to strike a golf ball is similar to the method discussed in previous embodiments. The interchangeable hosel 58" and alternative weight 104 configurations and operation differ from previous embodiment. The attachment methods and operation are discussed in greater detail in the following paragraphs.

Hosel Configuration and Operation—FIGS. 16A Through 16C

The golfer first configures golf club assembly 100 for a right handed (FIG. 10A) or left handed (FIG. 10B) golfer in a similar manner as previous embodiments. In one alternative embodiment, alternative hosel fastener hole 110 and hosel fastener 62' are disposed in sole region 91 of club head 101'. If hosel fastener 62' is threaded, it may be removed by rotation with an appropriate tool until hosel fastener 62' may be removed. Once hosel fastener 62' is removed, interchangeable hosel 58" is removed from hosel installation pocket 72', rotated about its vertical axis (z-axis) 180 degrees and replaced into hosel installation pocket 72'. Hosel fastener 62' is re-installed through alternative hosel fastener hole 110 and threaded into hosel fastener hole 84" and tightly secured with an appropriate tool. Counter-bored alternative hosel fastener hole 110 keeps the fastener head flush or slightly recessed into sole region 91 of the club head 101' to prevent the fastener head from contacting the ground or putting surface and adversely interfering with the golf swing. Shaft 52 is attached to interchangeable hosel 58" with the methods and materials previously described while hosel fastener 62' is oriented vertically in sole region 91 instead of horizontally as described and illustrated in FIG. 9A.

Weight Configuration & Operation

One embodiment of club head assembly 103 allows golfers to add, remove, or interchange a plurality of alternative weight 104 located along parabolic path 44 (FIG. 2A) and concealed in sole region 91. Alternative weight 104 allows golfers to easily alter the overall weight, MOI, CG and make club head assembly 103 face, tail, heel or toe weighted or any combination of these weighting configurations. The overall weight, MOI, CG and other weighting configurations affect club head assembly 103 in a similar manner to those illustrated and describe previously for other embodiments.

The alternative weight 104 adjustment options allow golfers to accurately match their swing type promoting consistent swing paths and fewer pushed and pulled shots. Additionally, the plurality of alternative weight 104 are located in the sole region 91 of club head 101' keeping alternative weight 104 concealed from view during normal address.

Golfers adjust club head assembly 103 mass and weighting by first inserting at least one of a plurality of alternative weight 104 into at least one of a plurality of weight pocket 102 on club head 101'. Alternative weight 104 are installed by aligning weight locking pocket 108 with one of the plurality of weight locking boss 105 (FIG. 16C) located at the base of weight pocket 102. Weight locking pocket 108 exactly matches the shape and depth of weight locking boss 105 (FIG. 16C) to provide secure attachment unable to rotate when weight fastener 64' is installed. Alternative weight 104 is considered seated when weight locking boss 105 (FIG. 16C) and the mating weight locking pocket 108 are aligned and weight base 51" (FIGS. 13A through 13C) contacts the base of weight pocket 102.

Once alternative weight 104 is seated weight fastener 64' is inserted from sole region 91 (bottom) side of club head 101' through weight locking hole 98" (FIG. 13A) and threadedly engaged into weight fastener receiving bore 107 (FIG. 16C). Weight fastener 64' is tightened against the base of the counter-bore or countersink of weight locking hole 98" (FIG. 13A) to secure alternative weight 104 located in weight pocket 102 to club head 101'. Weight fastener 64' is tightened with an appropriate tool until weight base 51" (FIGS. 13B and 13C) is tightly secured against the base surface of weight pocket 102 with weight locking pocket 108 fully engaged in weight locking boss 105 (FIG. 16C). This process is repeated until the quantity of alternative weight 104 selected by the golfer is secured to club head 101' in any remaining unoccupied weight pocket 102.

Alternative weight 104 removal is opposite of installation by loosening weight fastener 64' with an appropriate tool. Weight fastener 64' is rotated until disengaged from weight fastener receiving bore 107 and completely removed from alternative weight 104. Alternative weight 104 is removed from weight pocket 102 by disengaging weight locking pocket 108 from weight locking boss 105 and completely removing alternative weight 104 from weight pocket 102. Once alternative weight 104 is removed an alternative weight 104 is selected from a plurality of similar or different size and mass alternative weight 104 (FIG. 13A through 13C) and placed in at least one of the plurality of weight pocket 102.

Operation of Alternative Embodiment—17A Through 17B

An exploded view of an alternative embodiment detailing a club head assembly 103' is illustrated in FIGS. 17A and 17B and is used to describe the alternative parabolic weight 116 configuration and operation in an alternative embodiment. The manner of using golf club 100 (FIGS. 10A through 10C) to strike a golf ball is similar to the methods discussed in previous embodiments.

Weight Configuration & Operation

One embodiment of club head assembly 103' illustrated in FIGS. 17A-17C allows the golfer to add, remove, or interchange an alternative parabolic weight 116 which follows a parabolic path 44 (FIG. 2A). Alternative parabolic weight 116 allows golfers to easily alter the overall weight, MOI, CG and make club head assembly 103' face, tail, heel or toe weighted or any combination of these weighting configurations to match their weighted feel and swing path. The overall weight, MOI, CG and other weighting configurations affect club head assembly 103' in a similar manner to those illustrated and describe previously for other embodiments.

Golfers adjust club head assembly 103' mass and weighting by installing alternative parabolic weight 116 into parabolic weight receiving bore 118 contained in club head 101". Alternative parabolic weight 116 is installed by aligning each parabolic weight alignment bore 120 with each weight attachment boss 114 located at the base of parabolic weight receiving bore 118. Alternative parabolic weight 116 shape, depth and profile matches the shape, depth and profile of parabolic weight receiving bore 118 to provide secure attachment unable to rotate and move when weight fastener 64" is installed. Alternative parabolic weight 116 is considered seated when parabolic weight top 111 is contacting the mating base of parabolic weight receiving bore 118 and parabolic weight base 113 is flush or slightly recessed in sole region 91 of club head 101".

Once alternative parabolic weight 116 is seated weight fastener 64" is inserted from parabolic weight base 113 and sole region 91 side of club head 101" through alternative weight fastener hole 112 and threadedly engaged into weight fastener receiving bore 107'. Weight fastener 64" is rotated to tighten the fastener head against the base of the counter-bore or countersink of alternative weight fastener hole 112 to secure alternative parabolic weight 116 to club head 101".

Weight fastener 64" is tightened with an appropriate tool until parabolic weight top 111 is tightly secured against the base surface of parabolic weight receiving bore 118 with weight attachment boss 114 fully engaged in parabolic weight alignment bore 120 and parabolic weight base 113 flush or slightly recessed in sole region 91 of club head 101". This process is repeated until alternative parabolic weight 116 is secured to club head 101" with enough weight fasteners 64" to fill all alternative weight fastener hole 112. Counter-bored alternative weight fastener hole 112 keeps the fastener head flush or slightly recessed into parabolic weight base 113 to prevent the fastener head used to secure alternative parabolic weight 116 to club head 101" from contacting the ground or putting surface and adversely interfering with the golf swing.

Alternative parabolic weight 116 removal is opposite of installation by first completely removing weight fastener 64" with an appropriate tool. Alternative parabolic weight 116 is removed from parabolic weight receiving bore 118 by disengaging parabolic weight alignment bore 120 from weight attachment boss 114 and completely removing alternative parabolic weight 116 from parabolic weight receiving bore 118. Once alternative parabolic weight 116 is removed an alternative parabolic weight 116 with a larger or smaller mass may be substituted and installed in parabolic weight receiving bore 118.

In another embodiment alternative parabolic weight 116 may be divided into multiple thin plates or parabolic mass insert plate 124 (FIGS. 14C and 14D). At least one of a plurality of parabolic mass insert plate 124 is installed into parabolic weight receiving bore 118. Parabolic weight alignment bore 120' (FIGS. 14C and 14D) located in parabolic mass insert plate 124 is inserted over each weight attachment boss 114 within parabolic weight receiving bore 118. Mass insert plate 124 is retained by installing a parabolic mass base plate 119 (FIGS. 14C and 14D) over the last mass insert plate 124. Weight fastener 64" is inserted through alternative weight fastener hole 112' then through parabolic weight alignment bore 120' and threaded into weight fastener receiving bore 107' following a similar procedure to the installation description discussed in previous embodiments. The installation and removal is similar to installation and removal of alternative parabolic weight 116 however there may be multiple mass insert plates 124 and a parabolic mass base plate 119 in place of the singular alternative parabolic weight 116.

The combination of mass insert plates 124 and parabolic mass base plate 119 (FIGS. 14C and 14D) allows golfers to adjust the CG between top region 93 and sole region 91. A golfer may install mass insert plates 124 with greater density toward top region 93 and mass insert plates with less density toward sole region 91. The CG is closer to top region 93 and may result in a downward impact on golf ball causing golf ball to jump at impact. Additionally, a golfer may install mass insert plates 124 with greater density toward sole region 91 and mass insert plates with less density toward top region 93. The CG is closer to sole region 91 and may result in a upward impact on golf ball causing golf ball to receive top spin and roll forward at impact. Finally, a golfer may install mass insert plates 124 with greater density equidistant between sole region 91 and top region 93. The CG equidistant between sole region 91 and top region 93 and may result in a neutral impact on golf ball causing golf ball to skid forward at impact. The mass insert plates 124 combinations discussed illustrate possible configurations a golfer may choose depending on individual playing style, swing style, course conditions and a variety of other factors.

Operation of Alternative Embodiment—18A Through 18C

An exploded view of an alternative embodiment detailing a club head assembly 103" illustrated in FIGS. 18A through 18C is used to describe parabolic weight cartridge 121 configuration and operation in an alternative embodiment. The manner of using golf club 100 (FIGS. 10A through 10C) to strike a golf ball is similar to the methods discussed in previous embodiments.

Weight Configuration & Operation

One embodiment of club head assembly 103" allows the golfer to add, remove, or interchange a parabolic weight cartridge 121' consisting of a plurality of parabolic mass insert bores 122 disposed along a parabolic path 44 (FIG. 2A) and concealed in sole region 90 of club head 101". Parabolic weight cartridge 121' allows golfers to easily alter the overall weight, MOI, CG. The overall weight, MOI, CG and other weighting configurations affect club head assembly 103" in a similar manner to those illustrated and described for previous embodiments.

Golfers install alignment bore weight 126 and solid weight 128 into at least one of the plurality of parabolic mass insert bores 122. Alignment bore weight 126 may be installed in any of the plurality of parabolic mass insert bores. Alignment bore weight 126 is intended for installation in parabolic mass insert bores 122 consisting of alternative weight fastener hole 112" to allow weight locking hole 98'" to provide clearance for weight fastener 64". Weight fastener 64" is used to secure parabolic weight cartridge 121' to putter head assembly 103". Solid weight 128 may be installed in parabolic mass insert bores not containing alternative weight fastener hole 112'. When the golfer has installed alignment bore weight 126 and solid weight 128 in their chosen parabolic mass insert bores 122, parabolic weight cartridge 121' may be fastened to putter head assembly 103".

Parabolic weight cartridge 121' is attached to club head assembly 103" by inserting parabolic weight cartridge 121', an assemblage containing solid weights 128 and alignment bore weight 126, into parabolic weight receiving bore 118. Parabolic weight cartridge 121' is installed by aligning all internal weight alignment bore 130 with all weight attachment boss 114 located at the base of parabolic weight receiving bore 118. Parabolic weight cartridge 121' shape, depth and profile matches the shape, depth and profile of parabolic weight receiving bore 118 to provide secure attachment unable to rotate when weight fastener 64" is installed. Parabolic weight cartridge 121' is considered seated when parabolic weight top 111" is contacting the mating base of parabolic weight receiving bore 118 located in the sole region 91 of club head 103".

Parabolic weight cartridge 121' may be attached to putter head assembly 103" utilizing a weight fastener 64". Weight fastener 64" is inserted through alternative weight fastener hole 112" starting from parabolic weight base 113". Weight fastener 64" passes through alternative weight fastener hole 112" in parabolic weight cartridge 121', through weight locking hole 98'" in alignment bore weight 126. Weight fastener 64" is finally threadedly engaged in weight fastener receiving bore 107'. Weight fastener 64" is tightened against the base of the counter-bore or countersink of alternative weight fastener hole 112" to secure parabolic weight cartridge 121' located in parabolic weight receiving bore 118 to club head 103". Weight fastener 64" is tightened with an appropriate tool until parabolic weight top 111" is tightly secured against the base surface of parabolic weight receiving bore 118 with weight attachment boss 114 fully engaged in internal weight alignment bore 130. This process is repeated until parabolic weight cartridge 121' is secured to club head 103" and each alternative weight fastener hole 112" contains a weight fastener 64". Alignment bore weight 126 and solid weight 128 may be substituted in any parabolic mass insert bore 122 in parabolic weight cartridge 121' to adjust club head assembly 103" mass, CG, MOI or other characteristics to appeal to the individual golfer.

Parabolic weight cartridge 121' removal is opposite of installation by first removing weight fastener 64" with an appropriate tool. After weight fastener 64" is completely removed from parabolic weight cartridge 121' and weight fastener receiving bore 107', parabolic weight cartridge 121' is removed from parabolic weight receiving bore 118 by disengaging weight alignment bore 130 from weight attachment boss 114 and completely removing parabolic weight cartridge 121', alignment bore weight 126, and solid weight 128 assembly from parabolic weight receiving bore 118. Once parabolic weight cartridge 121' is removed alignment bore weight 126 and solid weight 128 may be removed and rearranged in nearly infinite combinations. A variety of alignment bore weight 126 and solid weight 128 of various sizes and masses may be removed and installed in various arrangements within parabolic weight cartridge 121'.

The counter-bore, countersink, or similar feature of alternative weight fastener hole 112" provides a recess to conceal a fastener head such as the head found on a cap screw. The head of the cap screw seats against the back surface of the first large counter-bored cavity portion. The recess provided by the counter-bore keeps the fastener head flush or slightly recessed into parabolic weight cartridge 121' of club head assembly 103" to prevent the fastener head on weight fastener 64" from contacting the ground or putting surface and adversely interfering with the golf swing.

Although the descriptions above contain many specific examples, these should not be construed as limiting the scope of the embodiments but as merely providing illustrations of some of several embodiments. For example, the club head 101' can have other shapes such as cylindrical, cubic, conic, etc. The shaft mounting provisions may be an interchangeable hosel 58, 58' and 58", integral hosel, or hole bored into the club head 101' to directly mount the shaft. The weights can be made from various materials in various shapes and sizes. It can be appreciated there are infinite design possibilities for the parabolic golf club system components, component shapes and weight concealment or configuration options, therefore the scope of the embodiments should be determined by the appended claims and their legal equivalents, rather than by the examples given.

ADVANTAGES

From the descriptions above, a number of advantages of some embodiments of our parabolic golf club system become evident:

(a) the golf club utilizes the reflective parabolic properties by placing the club face at the directrix and the hosel at the focus of a parabolic path to optimize golf club balance and control improving accuracy and consistency for golfers of all skill levels (b) the parabolic golf club system further allows golfers to optimize weighting and improve the reflective parabolic properties by adjusting the weight distribution along a parabolic path allowing the weight to be adjusted on both sides on the axis of symmetry and between face region, tail region, heel region, toe region, sole region and top region (c) the parabolic golf club system allows golfers to select from a variety of hosels with various loft angles and lie angles, and other configurations to position the golfer's proximity to the club head optimizing head, arm and hand placement and stance to satisfy the individual golfer.

(d) the parabolic golf club system allows golfers to select from a variety of faces, face patterns, face loft angles and face inserts to customize the golf club and augment the parabolic properties (e) the parabolic golf club system allows golfers to easily change the interchangeable hosel position between a right-hand and left-hand configuration (f) various embodiments of the club head allow golfers to place weights on the top where the weights are visible during address allowing golfers to visually see how weight position affects swing path and club face squaring when impacting the golf ball (g) other embodiments of the club head allow golfers to conceal the weights in the sole so the club head and sight aids are visible during the swing allowing the golfer to concentrate on alignment and impacting the golf ball (h) yet other embodiments utilize various sizes and shapes of weights moved into various locations and applied in various combinations to alter overall mass, CG and MOI locations within the horizontal plane and between the top region and sole region by stacking weight plates or filling a weight cartridge with smaller weights of various densities

CONCLUSION, RAMIFICATIONS, AND SCOPE

Accordingly, the reader will see that the parabolic golf club system of the various embodiments provides golfers with an exceptionally balanced parabolic design by allowing weight adjustment along a parabolic path with the face and hosel optimally located at the directrix and focus. The reflective parabolic properties create a stable golf club platform improving putting accuracy and consistency. Additionally, the golfer further enhances the performance and customizes the golf club by selecting from several face patterns, inserts, materials, hosels, weights and club head styles.

We claim:

1. A golf club assembly comprising: A) a shaft; B) a club head comprising: a parabola and a planar striking face; C) means for integrally forming and attaching said planar striking face to said club head, whereby said planar striking face is substantially disposed coincident and parallel to a directrix of said parabola; and D) means for demountably coupling said shaft to said club head with said shaft being substantially disposed at a focus of said parabola, whereby a primary longitudinal axis and projection of said primary longitudinal axis passes through said focus of said parabola within said club head.

2. The golf club assembly of claim 1, further comprising in combination, a plurality of weight fastener cavities and weight locking pockets integrally formed into said club head and disposed along an arcuate path defined by said parabola, whereby weight is able to be demountably coupled to said club head at locations defined by said weight fastener cavities and said weight locking pockets.

3. The golf club assembly of claim 1, further comprising a hosel installation pocket integrally formed into said club head at a focus defined by said parabola, wherein an interchangeable hosel with various angle adjustments selected from the group consisting of lie angle and loft angle is able to be demountably coupled to said golf club assembly in a right-handed or left-handed configuration.

4. The golf club assembly of claim 1, wherein said means for joining said shaft to said club head comprises said interchangeable hosel having in combination, a substantially cylindrical hosel shaft mounting boss and a shaft stop ring such that a distal end of said shaft is engaged over said hosel shaft mounting boss until said shaft end contacts said shaft stop ring.

5. The golf club assembly of claim 1, wherein said means for joining said shaft to said club head comprises, an interchangeable hosel having a substantially cylindrical hosel shaft mounting bore such that a distal end of said shaft is urged into said hosel shaft mounting bore until said shaft end contacts the bottom of said hosel shaft mounting bore.

6. The golf club assembly of claim 1, further comprising a face insert cavity formed into said planar striking face, located at the ball striking side of said club head, defined by a sole region on the bottom, a top region opposite the sole region, a toe region on one side, and a heel region opposite the toe region, whereby a face insert is urged into said face insert cavity becoming flush with said planar striking face, disposed coincident and parallel to a directrix of said parabola.

7. The golf club assembly of claim 1, wherein said club head is a putter type club head.

8. A golf club assembly comprising: A) a shaft; B) a club head comprising: a parabola and a planar striking face; C) a plurality of vertical hollow bores located in a sole region of said club head, concealed from view during normal address and disposed along an arcuate path defined by said parabola; D) means for integrally forming and attaching said planar striking face to said club head, whereby said planar striking face is substantially disposed coincident and parallel to a directrix of said parabola; and E) means for demountably coupling said shaft to said club head, said shaft being substantially disposed at a focus of said parabola, whereby a primary longitudinal axis and projection of said primary longitudinal axis passes through said focus of said parabola within said club head.

9. The golf club assembly of claim 8, wherein the plurality of said vertical hollow bores comprise in combination, a weight locking boss and weight fastener receiving bore disposed at base of said hollow bores integrally formed into said club head and disposed along an arcuate path defined by said parabola, where weight is able to be demountably coupled to said club head at locations defined by the plurality of said vertical hollow bores, said weight locking boss, and said weight fastener receiving bores.

10. The golf club assembly of claim 8, further comprising a hosel installation pocket integrally formed into said club head at a focus defined by said parabola, wherein an interchangeable hosel with various angle adjustments selected from the group consisting of lie angle and loft angle is able to be demountably coupled to said golf club assembly in a right handed or left-handed configuration.

11. The golf club assembly of claim 8, wherein said means for joining said shaft to said club head comprises, an interchangeable hosel having a substantially cylindrical hosel shaft mounting bore such that a distal end of said shaft is urged into said hosel shaft mounting bore until said shaft end contacts the bottom of said hosel shaft mounting bore.

12. The golf club assembly of claim 8, further comprising a face insert cavity formed into said planar striking face, located at the ball striking side of said club head, defined by a sole region on the bottom, a top region opposite the sole region, a toe region on one side, and a heel region opposite the toe region, whereby a face insert is urged into said face insert cavity becoming flush with said planar striking face, disposed coincident and parallel to a directrix of said parabola.

13. The golf club assembly of claim 8, wherein said club head is a putter type club head.

14. The golf club assembly of claim 8, wherein said means for joining said shaft to said club head comprises said interchangeable hosel having in combination, a substantially cylindrical hosel shaft mounting boss and a shaft stop ring such that a distal end of said shaft is engaged over said hosel shaft mounting boss until said shaft end contacts said shaft stop ring.

15. A golf club assembly comprising: A) a shaft; B) a club head comprising: a parabola and a planar striking face; C) an arcuate slot having a predetermined width and depth, located in a sole region of said club head and concealed from view during normal address; D) said depth is substantially located in the vertical direction of said club head; E) said width of said arcuate slot is centered along an arcuate path of said parabola, producing a arcuate cavity aligning with said parabola; F) means for integrally forming and attaching said planar striking face to said club head, whereby said planar striking face is substantially disposed coincident and parallel to a directrix of said parabola; and G) means for demountably coupling said shaft to said club head, said shaft being substantially disposed at a focus of said parabola, whereby a primary longitudinal axis and projection of said primary longitudinal axis passes through said focus of said parabola within said club head.

16. The golf club assembly of claim 15, wherein said arcuate slot comprises at least one attachment boss and weight fastener receiving bore, disposed at base of said arcuate slot to receive a parabolic weight detachably secured to said club head.

17. The golf club assembly of claim 15, wherein said arcuate slot comprises at least one attachment boss and weight fastener receiving bore, disposed at bottom of said arcuate slot, to receive a parabolic weight cartridge detachably secured to said club head, wherein said parabolic weight cartridge comprises a plurality of vertical hollow bores to receive at least one weight selected from the group consisting of alignment bore weight and solid weight, said alignment bore weight and said solid weight is able to be inserted into at least one of said plurality of vertical hollow bores, and said parabolic weight cartridge is detachably secured to said club head by threaded fasteners threadedly engaged into said weight fastener receiving bores, containing said alignment bore weights and solid weights between bottom of said arcuate slot and bottom of said parabolic mass insert bore.

18. The golf club assembly of claim 15, wherein said arcuate slot comprises at least one attachment boss and weight fastener receiving bore disposed at bottom of said arcuate slot, said arcuate slot is able to receive at least one parabolic mass insert plate contained and detachably secured to said club head by a parabolic weight base, whereby threaded fasteners are threaded engaged into said weight fastener receiving bores.

19. The golf club assembly of claim 15, further comprising a hosel installation pocket integrally formed into said club head at a focus defined by said parabola, wherein an interchangeable hosel with various angle adjustments selected from the group consisting of lie angle and loft angle is able to be demountably coupled to said golf club assembly in a right-handed or left-handed configuration.

20. The golf club assembly of claim 15, wherein said means for joining said shaft to said club head comprises an interchangeable hosel having in combination, a substantially cylindrical nasal shaft mounting boss and a shaft stop ring such that a distal end of said shaft is engaged over said hosel shaft mounting boss until said shaft end contacts said shaft stop ring.

21. The golf club assembly of claim 15, further comprising a face insert cavity formed into said planar striking face located at the ball striking side of said club head, defined by a sole region on the bottom, a top region opposite the sole region, a toe region on one side, and a heel region opposite the toe region, whereby a face insert is urged into said face insert cavity becoming flush with said planar striking face, disposed coincident and parallel to a directrix of said parabola.

22. The golf club assembly of claim 15, wherein said club head is a putter type club head.

23. The golf club assembly of claim 15, wherein said means for joining said shaft to said club head comprises, an interchangeable hosel having a substantially cylindrical hosel shaft mounting bore such that a distal end of said shaft is urged into said hosel shaft mounting bore until said shaft end contacts the bottom of said hosel shaft mounting bore.

* * * * *